US008733410B2

(12) United States Patent
Pervan

(10) Patent No.: US 8,733,410 B2
(45) Date of Patent: May 27, 2014

(54) METHOD OF SEPARATING A FLOORBOARD MATERIAL

(75) Inventor: Darko Pervan, Viken (SE)

(73) Assignee: Valinge Innovation AB, Viken (SE)

( * ) Notice: Subject to any disclaimer, the term of this patent is extended or adjusted under 35 U.S.C. 154(b) by 0 days.

(21) Appl. No.: 12/073,448

(22) Filed: Mar. 5, 2008

(65) Prior Publication Data

US 2008/0216920 A1 Sep. 11, 2008

Related U.S. Application Data

(63) Continuation of application No. 10/768,677, filed on Feb. 2, 2004, now Pat. No. 7,637,068, which is a continuation-in-part of application No. PCT/SE03/00514, filed on Mar. 31, 2003, application No. 12/073,448, which is a continuation of application No. 10/509,885, filed as application No. PCT/SE03/00514 on Mar. 31, 2003, now Pat. No. 7,757,452.

(60) Provisional application No. 60/446,564, filed on Feb. 12, 2003.

(30) Foreign Application Priority Data

Apr. 3, 2002 (SE) ..... 0201009
Jan. 31, 2003 (SE) ..... 0300271

(51) Int. Cl.
*B27F 1/00* (2006.01)

(52) U.S. Cl.
USPC ..... 144/347; 144/350; 144/367; 144/376

(58) Field of Classification Search
USPC ..... 144/347, 350, 359, 360, 363, 367, 376; 83/51, 885; 225/96.5
See application file for complete search history.

(56) References Cited

U.S. PATENT DOCUMENTS

| | | | |
|---|---|---|---|
| 213,740 | A | 4/1879 | Connor |
| 1,371,856 | A | 3/1921 | Cade |
| 1,787,027 | A | 12/1930 | Wasleff |
| 1,898,364 | A | 2/1933 | Gynn |
| 1,995,264 | A | 3/1935 | Mason |
| 2,123,409 | A | 7/1938 | Elmendorf |
| 2,387,446 | A | 10/1945 | Herz |
| 2,430,200 | A | 11/1947 | Wilson |

(Continued)

FOREIGN PATENT DOCUMENTS

| | | |
|---|---|---|
| AT | 218725 | 12/1961 |
| DE | 1 212 275 B | 3/1966 |

(Continued)

OTHER PUBLICATIONS

Laminate Flooring Tips (http://flooring.lifetips.com/cat/61734/laminate-flooring-tips/index.html). copyright 2000.*

(Continued)

*Primary Examiner* — Bena Miller
(74) *Attorney, Agent, or Firm* — Buchanan Ingersoll & Rooney P.C.

(57) ABSTRACT

A joint system having a flexible spring located in a horizontal groove of a panel, the spring having an inner flexible part and being displaceable horizontally in the groove.

17 Claims, 22 Drawing Sheets

(56) References Cited

U.S. PATENT DOCUMENTS

| | | | | |
|---|---|---|---|---|
| 2,740,167 | A | 4/1956 | Rowley | |
| 2,805,852 | A | 9/1957 | Malm | |
| 2,894,292 | A | 7/1959 | Gramelspacher | |
| 2,928,456 | A | 3/1960 | Potchen et al. | |
| 3,200,553 | A | 8/1965 | Frashour et al. | |
| 3,204,380 | A | 9/1965 | Smith et al. | |
| 3,282,010 | A | 11/1966 | King, Jr. | |
| 3,347,048 | A | 10/1967 | Brown | |
| 3,387,422 | A | 6/1968 | Wanzer | |
| 3,538,665 | A | 11/1970 | Gohner | |
| 3,720,027 | A | 3/1973 | Christensen | |
| 3,729,368 | A | 4/1973 | Ingham et al. | |
| 3,731,445 | A | 5/1973 | Hoffmann et al. | |
| 3,738,404 | A | 6/1973 | Walker | |
| 3,842,562 | A | 10/1974 | Daigle | |
| 3,859,000 | A | 1/1975 | Webster | |
| 3,927,705 | A | 12/1975 | Cromeens | |
| 4,028,450 | A | 6/1977 | Gould | |
| 4,083,390 | A | 4/1978 | Ingham | |
| 4,169,688 | A | 10/1979 | Toshio | |
| 4,196,554 | A | 4/1980 | Anderson et al. | |
| 4,426,820 | A | 1/1984 | Terbrack et al. | |
| 4,471,012 | A | 9/1984 | Maxwell | |
| 4,512,131 | A | 4/1985 | Laramore | |
| 4,599,841 | A | 7/1986 | Haid | |
| 4,819,932 | A | 4/1989 | Trotter, Jr. | |
| 5,135,597 | A * | 8/1992 | Barker | 156/264 |
| 5,148,850 | A | 9/1992 | Urbanick | |
| 5,165,816 | A | 11/1992 | Parasin | |
| 5,216,861 | A | 6/1993 | Meyerson | |
| 5,253,464 | A | 10/1993 | Nilsen | |
| 5,274,979 | A | 1/1994 | Tsai | |
| 5,295,341 | A | 3/1994 | Kajiwara | |
| 5,352,068 | A | 10/1994 | Roseliep | |
| 5,540,025 | A | 7/1996 | Takehara et al. | |
| 5,577,357 | A | 11/1996 | Civelli | |
| 5,671,575 | A | 9/1997 | Wu | |
| 5,695,875 | A | 12/1997 | Larsson et al. | |
| 5,755,068 | A | 5/1998 | Ormiston | |
| 5,797,237 | A | 8/1998 | Finkell | |
| 5,860,267 | A | 1/1999 | Pervan | |
| 5,950,389 | A | 9/1999 | Porter | |
| 6,006,486 | A * | 12/1999 | Moriau et al. | 52/589.1 |
| 6,021,615 | A | 2/2000 | Brown | |
| 6,101,778 | A | 8/2000 | Martensson | |
| 6,182,410 | B1 | 2/2001 | Pervan | |
| 6,203,653 | B1 | 3/2001 | Seidner | |
| 6,209,278 | B1 | 4/2001 | Tychsen | |
| 6,216,409 | B1 | 4/2001 | Roy et al. | |
| 6,254,301 | B1 | 7/2001 | Hatch | |
| 6,295,779 | B1 * | 10/2001 | Canfield | 52/656.4 |
| 6,332,733 | B1 | 12/2001 | Hamberger et al. | |
| 6,339,908 | B1 | 1/2002 | Chuang | |
| 6,358,352 | B1 * | 3/2002 | Schmidt | 156/254 |
| 6,385,936 | B1 | 5/2002 | Schneider | |
| 6,418,683 | B1 | 7/2002 | Martensson et al. | |
| 6,446,405 | B1 | 9/2002 | Pervan | |
| 6,450,235 | B1 * | 9/2002 | Lee | 160/236 |
| 6,490,836 | B1 | 12/2002 | Moriau et al. | |
| 6,497,079 | B1 | 12/2002 | Pletzer et al. | |
| 6,505,452 | B1 | 1/2003 | Hannig et al. | |
| 6,510,665 | B2 | 1/2003 | Pervan | |
| 6,576,079 | B1 * | 6/2003 | Kai | 156/182 |
| 6,591,568 | B1 | 7/2003 | Pålsson | |
| 6,601,359 | B2 | 8/2003 | Olofsson | |
| 6,647,689 | B2 | 11/2003 | Pletzer et al. | |
| 6,647,690 | B1 | 11/2003 | Martensson | |
| 6,681,820 | B2 * | 1/2004 | Olofsson | 144/368 |
| 6,682,254 | B1 | 1/2004 | Olofsson et al. | |
| 6,729,091 | B1 | 5/2004 | Martensson | |
| 6,763,643 | B1 | 7/2004 | Martensson | |
| 6,769,218 | B2 | 8/2004 | Pervan | |
| 6,769,219 | B2 | 8/2004 | Schwitte et al. | |
| 6,786,019 | B2 | 9/2004 | Thiers | |
| 6,802,166 | B1 | 10/2004 | Gerhard | |
| 6,851,241 | B2 | 2/2005 | Pervan | |
| 6,854,235 | B2 | 2/2005 | Martensson | |
| 6,874,292 | B2 | 4/2005 | Moriau et al. | |
| 6,880,307 | B2 | 4/2005 | Schwitte et al. | |
| 6,898,913 | B2 | 5/2005 | Pervan | |
| 7,040,068 | B2 * | 5/2006 | Moriau et al. | 52/591.3 |
| 7,051,486 | B2 * | 5/2006 | Pervan | 52/586.1 |
| 7,055,290 | B2 | 6/2006 | Thiers | |
| 7,121,058 | B2 | 10/2006 | Palsson et al. | |
| 7,127,860 | B2 | 10/2006 | Pervan et al. | |
| 7,131,242 | B2 | 11/2006 | Martensson et al. | |
| 7,171,791 | B2 | 2/2007 | Pervan | |
| 7,251,916 | B2 | 8/2007 | Konzelmann et al. | |
| 7,337,588 | B1 | 3/2008 | Moebus | |
| 7,356,971 | B2 | 4/2008 | Pervan | |
| 7,441,384 | B2 | 10/2008 | Miller et al. | |
| 7,441,385 | B2 | 10/2008 | Palsson et al. | |
| 7,484,338 | B2 | 2/2009 | Pervan et al. | |
| 7,596,920 | B2 | 10/2009 | Konstanczak | |
| 7,603,826 | B1 | 10/2009 | Moebus | |
| 7,632,561 | B2 | 12/2009 | Thiers | |
| 7,677,001 | B2 | 3/2010 | Pervan | |
| 7,874,119 | B2 | 1/2011 | Pervan et al. | |
| 7,954,295 | B2 | 6/2011 | Pervan | |
| 2002/0007609 | A1 | 1/2002 | Pervan | |
| 2002/0020127 | A1 | 2/2002 | Thiers | |
| 2002/0025232 | A1 | 2/2002 | Miller | |
| 2002/0056245 | A1 | 5/2002 | Thiers | |
| 2002/0178674 | A1 | 12/2002 | Pervan | |
| 2002/0178682 | A1 | 12/2002 | Pervan | |
| 2003/0029116 | A1 | 2/2003 | Moriau | |
| 2003/0037504 | A1 | 2/2003 | Schwitte et al. | |
| 2003/0079820 | A1 | 5/2003 | Palsson | |
| 2003/0140478 | A1 | 7/2003 | Olofsson | |
| 2004/0035078 | A1 | 2/2004 | Pervan | |
| 2004/0206036 | A1 | 10/2004 | Pervan | |
| 2004/0211143 | A1 | 10/2004 | Hanning | |
| 2005/0034404 | A1 | 2/2005 | Pervan | |
| 2005/0034405 | A1 | 2/2005 | Pervan | |
| 2005/0102937 | A1 | 5/2005 | Pervan | |
| 2005/0160694 | A1 | 7/2005 | Pervan | |
| 2005/0252130 | A1 | 11/2005 | Martensson | |
| 2006/0070333 | A1 | 4/2006 | Pervan | |
| 2006/0283127 | A1 | 12/2006 | Pervan | |
| 2007/0028547 | A1 | 2/2007 | Grafenauer et al. | |
| 2008/0000182 | A1 | 1/2008 | Pervan | |
| 2008/0000189 | A1 | 1/2008 | Pervan et al. | |
| 2008/0005992 | A1 | 1/2008 | Pervan | |
| 2008/0005999 | A1 | 1/2008 | Pervan | |
| 2008/0028707 | A1 | 2/2008 | Pervan | |
| 2008/0041008 | A1 | 2/2008 | Pervan | |
| 2008/0060308 | A1 | 3/2008 | Pervan | |
| 2008/0168737 | A1 | 7/2008 | Pervan | |
| 2008/0172856 | A1 | 7/2008 | Brouckaert | |
| 2008/0216434 | A1 | 9/2008 | Pervan | |
| 2009/0101236 | A1 | 4/2009 | Boucke | |
| 2009/0151291 | A1 | 6/2009 | Pervan | |
| 2011/0072754 | A1 | 3/2011 | Pervan et al. | |

FOREIGN PATENT DOCUMENTS

| | | | |
|---|---|---|---|
| DE | 2 159 042 | | 6/1973 |
| DE | 26 16 077 | A1 | 10/1977 |
| DE | 30 41 781 | A1 | 6/1982 |
| DE | 33 43 601 | A1 | 6/1985 |
| DE | 33 43 601 | C2 | 6/1985 |
| DE | 35 38 538 | A1 | 5/1987 |
| DE | 39 18 676 | A1 | 8/1990 |
| DE | 41 30 115 | A1 | 3/1993 |
| DE | 42 15 273 | A1 | 11/1993 |
| DE | 42 42 530 | A1 | 6/1994 |
| DE | 196 01 322 | A1 | 5/1997 |
| DE | 198 51 200 | C1 | 3/2000 |
| DE | 299 22 649 | U1 | 4/2000 |
| DE | 203 07 580 | U1 | 7/2003 |
| DE | 102 41 769 | B3 | 4/2009 |
| EP | 0 652 340 | A1 | 5/1995 |
| EP | 0 849 416 | A2 | 6/1998 |
| EP | 1 048 423 | A2 | 11/2000 |

(56) References Cited

FOREIGN PATENT DOCUMENTS

| | | | |
|---|---|---|---|
| EP | 1 120 515 | A1 | 8/2001 |
| EP | 1 146 182 | A2 | 10/2001 |
| EP | 1 317 983 | A2 | 6/2003 |
| EP | 1 349 995 | B1 | 1/2008 |
| FR | 1.293.043 | | 5/1962 |
| FR | 2 810 060 | A1 | 12/2001 |
| GB | 812671 | | 4/1959 |
| GB | 2 256 023 | A | 11/1992 |
| JP | 1-178659 | A | 7/1989 |
| JP | 3-169967 | A | 7/1991 |
| JP | 6-146553 | A | 5/1994 |
| JP | 6-320510 | A | 11/1994 |
| JP | 7-180333 | A | 7/1995 |
| JP | 7-300979 | A | 11/1995 |
| JP | 7-310426 | A | 11/1995 |
| JP | 8-109734 | A | 4/1996 |
| SE | 372 051 | B | 12/1974 |
| SE | 450 141 | B | 6/1987 |
| SE | 502 994 | C2 | 3/1996 |
| SE | 512 313 | C2 | 2/2000 |
| WO | WO 84/02155 | A1 | 6/1984 |
| WO | WO 93/13280 | A1 | 7/1993 |
| WO | WO 94/26999 | A1 | 11/1994 |
| WO | WO 96/27719 | A1 | 9/1996 |
| WO | WO 96/27721 | A1 | 9/1996 |
| WO | WO 97/47834 | A1 | 12/1997 |
| WO | WO 99/66151 | A1 | 12/1999 |
| WO | WO 99/66152 | A1 | 12/1999 |
| WO | WO 00/20705 | A1 | 4/2000 |
| WO | WO 00/20706 | A1 | 4/2000 |
| WO | WO 00/47841 | A1 | 8/2000 |
| WO | WO 00/66856 | A1 | 11/2000 |
| WO | WO 01/02669 | A1 | 1/2001 |
| WO | WO 01/07729 | A1 | 2/2001 |
| WO | WO 01/51732 | A1 | 7/2001 |
| WO | WO 01/53628 | A1 | 7/2001 |
| WO | WO 01/98604 | A1 | 12/2001 |
| WO | WO 02/055809 | A1 | 7/2002 |
| WO | WO 02/055810 | A1 | 7/2002 |
| WO | WO 02/060691 | A1 | 8/2002 |
| WO | WO 03/012224 | A1 | 2/2003 |
| WO | WO 03/083234 | A1 | 10/2003 |
| WO | WO 03/089736 | A1 | 10/2003 |
| WO | WO 01/51733 | A1 | 7/2004 |
| WO | WO 2004/079130 | A1 | 9/2004 |
| WO | WO 2005/068747 | A1 | 7/2005 |
| WO | WO 2006/090287 | A1 | 8/2006 |
| WO | WO 2006/117229 | A1 | 11/2006 |
| WO | WO 2007/019957 | A1 | 2/2007 |

OTHER PUBLICATIONS

Correspondence from Bütec cited during opposition procedure at EPO in DE Patent No. 3343601, including announcement of Oct. 1984 re "Das Festprogram von Bütec: Mehrzweckbühnen, tanzplatten, Schonbeläge, Tanzbeläge, Bestuhlung"; letter of Nov. 7, 2001 to Perstorp Support AB with attached brochure published Oct. 1984 and installation instructions published Nov. 1984; and letter of Nov. 19, 2001 to Perstorp Support AB.

Pervan, et al., U. S. Appl. No. 61/234,480, entitled "Methods and Arrangements Relating to Edge Machining of Building Panels," filed Aug. 17, 2009.

Pervan, et al., U. S. Appl. No. 61/234,491, entitled "Methods and Arrangements Relating to Edge Machining of Building Panels," filed Aug. 17, 2009.

Pervan, Darko, et al., U.S. Appl. No. 12/832,752, entitled "Methods and Arrangements Relating to Edge Machining of Building Panels," filed in the U. S. Patent and Trademark Office on Jul. 8, 2010.

Pervan, Darko, et al., U.S. Appl. No. 12/832,754, entitled "Methods and Arrangements Relating to Edge Machining of Building Panels," filed in the U. S. Patent and Trademark Office on Jul. 8, 2010.

Pervan, U. S. Appl. No. 12/785,784, entitled "Locking System for Floorboards," filed in the U. S. Patent and Trademark Office on May 24, 2010.

Pervan, U. S. Appl. No. 12/834,258, entitled "Locking System for Mechanical Joining of Floorboards and Method for Production Thereof," filed in the U.S. Patent and Trademark Office on Jul. 12, 2010.

Shaw Industries Group, Inc.'s Answer, Defenses and Counterclaims to Plaintiffs' First Amended Complaint and Counterclaim on Reply, *Akzenta Paneele + Profile GmbH, Akzenta Vertriebs GmbH and W. Classen GmbH & Co. KG* v. *Shaw Industries Group, Inc. and Välinge Innovation AB and Darko Pervan*, United States District Court for the Eastern District of Texas, Marshall Division, Case No. 2:10-CV-00016 (TJW)(CE), dated Jan. 7, 2011.

Answer, Affirmative Defenses and Counterclaims of Defendant Valinge Innovation AB to Plaintiffs' First Amended Complaint and Counterclaim on Reply, *Akzenta Paneele + Profile GmbH, Akzenta Vertriebs GmbH and W. Classen GmbH & Co. KG* v. *Shaw Industries Group, Inc. and Välinge Innovation AB and Darko Pervan*, United States District Court for the Eastern District of Texas, Marshall Division, Case No. 2:10-CV-00016 (TJW)(CE), dated Jan. 7, 2011.

Pervan, et al., U. S. Appl. No. 12/959,971, entitled "Locking System, Floorboard Comprising Such a Locking System, As Well As Method for Making Floorboards," filed Dec. 3, 2010.

Pervan, Darko, U.S. Appl. No. 13/105,236, entitled "Locking System for Mechanical Joining of Floorboards and Method for Production Thereof," filed in the U.S. Patent and Trademark Office on May 11, 2011.

Pervan, Darko, U. S. Appl. No. 13/099,488, entitled "Locking System and Flooring Board," filed in the U. S. Patent and Trademark Office on May 3, 2011.

International Search Report issued in PCT/SE03/00514, mailed Jul. 1, 2003, Swedish Patent Office, Stockholm, SE, 4 pages.

U.S. Appl. No. 13/479,607, filed May 24, 2012, Pervan et al.

Pervan, Darko, et al., U.S. Appl. No. 13/479,607, entitled "Locking System, Floorboard Comprising Such a Locking System, As Well As Method for Making Floorboards," filed in the U. S. Patent and Trademark Office on May 24, 2012.

Pervan, Darko, U.S. Appl. No. 13/920,647, entitled "Mechanical Locking System for Floorboards," filed in the U.S. Patent and Trademark Office on Jun. 18, 2013.

* cited by examiner

PRIOR ART

PRIOR ART

PRIOR ART

PRIOR ART

T1
T3
T2
6
T4

T1
T3
T2
T4
15

T1
T3
T2
T4
15
6
6

6

15

15
6

1
1'
6
21
21

1
1'
6
21
21

1
1'
6
21
21

1
20
P1
36
21
48
22
6
P2
10
14
8
1'

1
20
P1
36
21
21a
36
22
6
P2
10
14
8
1'

1
20
P1
36
21
67
36
22
6
10
14
8
1'

METHOD OF SEPARATING A FLOORBOARD MATERIAL

CROSS-REFERENCE TO RELATED APPLICATIONS

The present application is a continuation of U.S. patent application Ser. No. 10/768,677, filed on Feb. 2, 2004, now U.S. Pat. No. 7,637,068, which is a continuation-in-part of PCT/SE03/00514, filed on Mar. 31, 2003, and claims the priority of Swedish Patent Application No. SE 0300271-4, filed in Sweden on Jan. 31, 2003, Swedish Patent Application No. SE 0201009-8, filed in Sweden on Apr. 3, 2002, and claims the benefit of U.S. Provisional Patent Application No. 60/446,564, filed in the United States on Feb. 12, 2003. The present application is also a continuation of U.S. patent application Ser. No. 10/509,885, filed on Jun. 29, 2005, now U.S. Pat. No. 7,757,452, which is a national phase entry of PCT/SE03/00514, filed on Mar. 31, 2003, and claims the priority of Swedish Patent Application No. SE 0300271-4, filed in Sweden on Jan. 31, 2003, Swedish Patent Application No. SE 0201009-8, filed in Sweden on Apr. 3, 2002. The contents of U.S. Ser. No. 10/768,677, U.S. Ser. No. 10/509,885, PCT/SE03/00514, SE 0300271-4, SE 0201009-8, and U.S. 60/446,564 are incorporated herein by reference.

BACKGROUND OF THE INVENTION

1. Technical Field

The invention generally relates to the field of mechanical locking systems for floorboards, and to floorboards provided with such locking systems; blanks for such locking systems; and methods for making floorboards with such locking systems. The invention is particularly suited for use in mechanical locking systems of the type described and shown, for example, in WO9426999, WO9966151, WO9966152, SE 0100100-7 and SE0100101-5 (owned by Valinge Aluminium AB) but is also usable in optional mechanical locking systems which can be used to join floors. The invention also relates to floors of the type having a core and a decorative surface layer on the upper side of the core.

The present invention is particularly suitable for use in floating floors, which are formed of floorboards which are joined mechanically with a locking system integrated with the floorboard, i.e., mounted at the factory, are made up of one or more upper layers of veneer, decorative laminate or decorative plastic material, an intermediate core of wood-fiber-based material or plastic material and preferably a lower balancing layer on the rear side of the core, and are manufactured by sawing large floor elements into floor panels. The following description of prior-art techniques, problems of known systems and objects and features of the invention will therefore, as a non-restrictive example, be aimed above all at this field of application and in particular laminate flooring formed as rectangular floorboards intended to be mechanically joined on both long sides and short sides. However, it should be emphasized that the invention can be used in other types of floorboards with other types of locking systems, where the floorboards can be joined using a mechanical locking system in the horizontal and vertical directions. The invention can thus also be applicable to, for instance, homogeneous wooden floors, parquet floors with a core of wood or wood-fiber-based material and the like which are made as separate floor panels, floors with a printed and preferably also varnished surface and the like. The invention can also be used for joining, for instance, of wall panels.

2. Description of Related Art

Laminate flooring usually consists of a core of a 6-11 mm fiberboard, a 0.2-0.8 mm thick upper decorative surface layer of laminate and a 0.1-0.6 mm thick lower balancing layer of laminate, plastic, paper or like material. The surface layer provides appearance and durability to the floorboards. The core provides stability, and the balancing layer keeps the board plane when the relative humidity (RH) varies during the year. The floorboards are laid floating, i.e., without gluing, on an existing subfloor. Traditional hard floorboards in floating flooring of this type are usually joined by means of glued tongue-and-groove joints (i.e., joints involving a tongue on one floorboard and a tongue groove on an adjoining floorboard) on long side and short side. When laying the floor, the boards are brought together horizontally, whereby a projecting tongue along the joint edge of one board is introduced into a tongue groove along the joint edge of an adjoining board. The same method is used on the long side as well as on the short side.

In addition to such traditional floors, which are joined by means of glued tongue-and-groove joints, floorboards have recently been developed which do not require the use of glue and instead are joined mechanically by means of mechanical locking systems. These systems comprise locking means which lock the boards horizontally and vertically. The mechanical locking systems are usually formed by machining the core of the board. Alternatively, parts of the locking system can be formed of a separate material, for instance aluminum, which is integrated with the floorboard, i.e., joined with the floorboard in connection with the manufacture thereof.

The main advantages of floating floors with mechanical locking systems are that they can easily and quickly be laid by various combinations of inward angling, snapping in and insertion. They can also easily be taken up again and used once more at a different location. A further advantage of the mechanical locking systems is that the edge portions of the floorboards can be made of materials which need not have good gluing properties. The most common core material is a fiberboard with high density and good stability usually called HDF—High Density Fiberboard. Sometimes also MDF—Medium Density Fiberboard—is used as the core.

Laminate flooring and also many other floorings with a surface layer of plastic, wood, veneer, cork and the like are made by the surface layer and the balancing layer being applied to a core material. This application may take place by gluing a previously manufactured decorative layer, for instance when the fiberboard is provided with a decorative high pressure laminate which is made in a separate operation where a plurality of impregnated sheets of paper are compressed under high pressure and at a high temperature. The currently most common method when making laminate flooring, however, is direct laminating which is based on a more modern principle where both manufacture of the decorative laminate layer and the fastening to the fiberboard take place in one and the same manufacturing step. Impregnated sheets of paper are applied directly to the board and pressed together under pressure and heat without any gluing.

In addition to these two methods, a number of other methods are used to provide the core with a surface layer. A decorative pattern can be printed on the surface of the core, which is then, for example, coated with a wear layer. The core can also be provided with a surface layer of wood, veneer, decorative paper or plastic sheeting, and these materials can then be coated with a wear layer. The core can also be provided with a soft wear layer, for instance needle felt. Such a floor has good sound properties.

As a rule, the above methods result in a floor element in the form of a large board which is then sawn into, for instance, some ten floor panels, which are then machined to floorboards. The above methods can in some cases result in completed floor panels and sawing is then not necessary before the machining to completed floorboards is carried out. Manufacture of individual floor panels usually takes place when the panels have a surface layer of wood or veneer.

In all cases, the above floor panels are individually machined along their edges to floorboards. The machining of the edges is carried out in advanced milling machines where the floor panel is exactly positioned between one or more chains and bands mounted, so that the floor panel can be moved at high speed and with great accuracy past a number of milling motors, which are provided with diamond cutting tools or metal cutting tools, which machine the edge of the floor panel. By using several milling motors operating at different angles, advanced joint geometries can be formed at speeds exceeding 100 m/min and with an accuracy of .+−.0.02 mm.

Definition of Some Terms

In the following text, the visible surface of the installed floorboard is called "front side", while the opposite side of the floorboard, facing the subfloor, is called "rear side". The sheet-shaped starting material that is used is called "core". When the core is coated with a surface layer closest to the front side and preferably also a balancing layer closest to the rear side, it forms a semimanufacture which is called "floor panel" or "floor element" in the case where the semimanufacture, in a subsequent operation, is divided into a plurality of floor panels mentioned above. When the floor panels are machined along their edges so as to obtain their final shape with the locking system, they are called "floorboards". By "surface layer" are meant all layers applied to the core closest to the front side and covering preferably the entire front side of the floorboard. By "decorative surface layer" is meant a layer which is mainly intended to give the floor its decorative appearance. "Wear layer" relates to a layer which is mainly adapted to improve the durability of the front side. In laminate flooring, this layer usually consists of a transparent sheet of paper with an admixture of aluminum oxide which is impregnated with melamine resin. By "reinforcement layer" is meant a layer which is mainly intended to improve the capability of the surface layer of resisting impact and pressure and, in some cases, compensating for the irregularities of the core so that these will not be visible at the surface. In high pressure laminates, this reinforcement layer usually consists of brown kraft paper which is impregnated with phenol resin. By "horizontal plane" is meant a plane which extends parallel with the outer part of the surface layer. Immediately juxtaposed upper parts of two neighboring joint edges of two joined floorboards together define a "vertical plane" perpendicular to the horizontal plane.

The outer parts of the floorboard at the edge of the floorboard between the front side and the rear side are called "joint edge". As a rule, the joint edge has several "joint surfaces" which can be vertical, horizontal, angled, rounded, beveled etc. These joint surfaces exist on different materials, for instance laminate, fiberboard, wood, plastic, metal (especially aluminum) or sealing material. By "joint edge portion" are meant the joint edge of the floorboard and part of the floorboard portions closest to the joint edge.

By "joint" or "locking system" are meant coacting connecting means which connect the floorboards vertically and/or horizontally. By "mechanical locking system" is meant that joining can take place without glue. Mechanical locking systems can in many cases also be joined by gluing.

The above techniques can be used to manufacture laminate floorings which are highly natural copies of wooden flooring, stones, tiles and the like and which are very easy to install using mechanical locking systems. Length and width of the floorboards are as a rule 1.2*0.2 m. Recently also laminate floorings in other formats are being marketed. The techniques used to manufacture such floorboards with mechanical locking systems, however, are still relatively expensive since the machining of the joint portions for the purpose of forming the mechanical locking system causes considerable amounts of wasted material, in particular when the width of the floorboards is reduced so that the length of the joint portions per square meter of floor surface increases. It should be possible to manufacture new formats and to increase the market for these types of flooring significantly if the mechanical locking systems could be made in a simpler and less expensive manner and with improved function.

Conventional Techniques and Problems Thereof

With a view to facilitating the understanding and the description of the present invention as well as the knowledge of the problems behind the invention, both the basic construction and the function of floorboards according to WO 9426999 as well as the manufacturing principles for manufacturing laminate flooring and mechanical locking systems in general will now be described with reference to FIGS. 1-8 in the accompanying drawings. In applicable parts, the subsequent description of prior-art techniques also applies to the embodiments of the present invention that will be described below.

FIGS. 3*a* and 3*b* show a floorboard 1 according to WO 9426999 from above and from below, respectively. The board 1 is rectangular and has an upper or front side 2, a rear or lower side 3, two opposite long sides with joint edge portions 4*a* and 4*b*, respectively, and two opposite short sides with joint edge portions 5*a* and 5*b*, respectively.

Both the joint edge portions 4*a*, 4*b* of the long sides and the joint edge portions 5*a*, 5*b* of the short sides can be joined mechanically without glue in a direction D2 in FIG. 1*c*, so as to meet in a vertical plane VP (marked in FIG. 2*c*) and in such manner that, when installed, they have their upper sides in a common horizontal plane HP (marked in FIG. 2*c*).

In the shown embodiment which is an example of floorboards according to WO 9426999 (FIGS. 1-3 in the accompanying drawings), the board 1 has a factory-mounted flat strip 6, which extends along the entire long side 4*a* and which is made of a bendable, resilient aluminum sheet. The strip 6 extends outwards past the vertical plane VP at the joint edge portion 4*a*. The strip 6 can be mechanically attached according to the shown embodiment or by gluing or in some other way. As stated in said publication, it is possible to use as material of a strip, which is attached to the floorboard at the factory, also other strip materials, such as sheet of some other metal, aluminum or plastic sections. As is also stated in WO 9426999, the strip 6 can instead be formed integrally with the board 1, for instance by suitable machining of the core of the board 1.

The present invention is mainly usable to improve floorboards where the strip 6 or at least part thereof is formed in one piece with the core, and the invention solves special problems that exist in such floorboards and the manufacture thereof. The core of the floorboard need not be, but is preferably, made of a uniform material. The strip 6 is always integrated with the board 1, i.e., it should be formed on the board or be factory mounted. A similar, although shorter strip 6' is arranged along one short side 5*a* of the board 1.

The part of the strip 6 projecting past the vertical plane VP is formed with a locking element 8 which extends along the entire strip 6. The locking element 8 has in the lower part an operative locking surface 10 facing the vertical plane VP and having a height of, e.g., 0.5 mm. During laying, this locking surface 10 coacts with a locking groove 14 which is formed in the underside 3 of the joint edge portion 4*b* on the opposite long side of an adjoining board 1'. The strip 6' along one short side is provided with a corresponding locking element 8', and the joint edge portion 5*b* of the opposite short side has a corresponding locking groove 14'. The edge of the locking grooves 14, 14' facing away from the vertical plane VP forms an operative locking surface 10' for coaction with the operative locking surface 10 of the locking element.

For mechanical joining of long sides as well as short sides also in the vertical direction (direction D1 in FIG. 1*c*), the board 1 is also along one long side (joint edge portion 4*a*) and one short side point edge portion 5*a*) formed with a laterally open recess or groove 16. This is defined upwards by an upper lip at the joint edge portion 4*a*, 5*a* and downwards by the respective strips 6, 6'. At the opposite edge portions 4*b* and 5*b* there is an upper milled-out portion 18 which defines a locking tongue 20 coacting with the recess or groove 16 (see FIG. 2*a*).

FIGS. 1*a*-1*c* show how two long sides 4*a*, 4*b* of two such boards 1, 1' on a base U can be joined by downward angling by turning about a center C close the intersection between the horizontal plane HP and the vertical plane VP while the boards are held essentially in contact with each other.

FIGS. 2*a*-2*c* show how the short sides 5*a*, 5*b* of the boards 1, 1' can be joined by snap action. The long sides 4*a*, 4*b* can be joined by means of both methods, while the joining of the short sides 5*a*, 5*b*—after laying the first row of floorboards—is normally carried out merely by snap action, after joining of the long sides 4*a*, 4*b*.

When a new board 1' and a previously installed board 1 are to be joined along their long side edge portions 4*a*, 4*b* according to FIGS. 1*a*-1*c*, the long side edge portion 4*b* of the new board 1' is pressed against the long side edge portion 4*a* of the previously installed board 1 according to FIG. 1*a*, so that the locking tongue 20 is inserted into the recess or groove 16. The board 1' is then angled down towards the subfloor U according to FIG. 1*b*. The locking tongue 20 enters completely the recess or groove 16 while at the same time the locking element 8 of the strip 6 snaps into the locking groove 14. During this downward angling, the upper part 9 of the locking element 8 can be operative and perform guiding of the new board 1' towards the previously installed board 1.

In the joined position according to FIG. 1*c*, the boards 1, 1' are certainly locked in the D1 direction as well as the D2 direction along their long side edge portions 4*a*, 4*b*, but the boards 1, 1' can be displaced relative to each other in the longitudinal direction of the joint along the long sides (i.e., direction D3).

FIGS. 2*a*-2*c* show how the short side edge portions 5*a* and 5*b* of the boards 1, 1' can be mechanically joined in the D1 direction as well as the D2 direction by the new board 1' being displaced essentially horizontally towards the previously installed board 1. In particular this can be done after the long side of the new board 1' by inward angling according to FIGS. 1*a*-*c* has been joined with a previously installed board 1 in a neighboring row. In the first step in FIG. 2*a*, beveled surfaces adjacent to the recess 16 and the locking tongue 20, respectively, coact so that the strip 6' is forced downwards as a direct consequence of the joining of the short side edge portions 5*a*, 5*b*. During the final joining, the strip 6' snaps upwards when the locking element 8' enters the locking groove 14', so that the operative locking surfaces 10, 10' of the locking element 8' and the locking groove 14', respectively, come into engagement with each other.

By repeating the operations illustrated in FIGS. 1*a*-1*c* and 2*a*-*c*, the entire installation can be made without gluing and along all joint edges. Thus, floorboards of the above-mentioned type can be joined mechanically by, as a rule, first being angled down on the long side and by the short sides, once the long side is locked, snapping together by horizontal displacement of the new board 1' along the long side of the previously installed board 1 (direction D3). The boards 1, 1' can, without the joint being damaged, be taken up again in reverse order of installation and then be laid once more. Parts of these laying principles are applicable also in connection with the present invention.

The locking system enables displacement along the joint edge in the locked position after an optional side has been joined. Therefore laying can take place in many different ways which are all variants of the three basic methods.

Angling of long side and snapping-in of short side.

Snapping-in of long side—snapping-in of short side.

Angling of short side, displacement of the new board along the short side edge of the previous board and finally downward angling of two boards. These methods of laying can also be combined with insertion along the joint edge.

The most common and safest laying method is that the long side is first angled downwards and locked against another floorboard. Subsequently, a displacement in the locked position takes place towards the short side of a third floorboard so that the snapping-in of the short side can take place. Laying can also be made by one side, long side or short side, being snapped together with another board. Then a displacement in the locked position takes place until the other side snaps together with a third board. These two methods require snapping-in of at least one side. However, laying can also take place without snap action. The third alternative is that the short side of a first board is angled inwards first towards the short side of a second board, which is already joined on its long side with a third board. After this joining-together, the first and the second board are, as a rule, slightly angled upwards. The first board is displaced in the upwardly angled position along its short side until the upper joint edges of the first and the third board are in contact with each other, after which the two boards are jointly angled downwards.

The above-described floorboard and its locking system have become very successful on the market. A number of variants of this locking system are available on the market, above all in connection with laminate floors but also thin wooden floors with a surface of veneer and parquet floors.

Taking-up can be carried out in several different ways. However, all methods require that the long sides can be angled upwards. After that the short sides can be angled upwards or be pulled out along the joint edge. One exception is small floorboards with a size corresponding to a parquet block, which are laid, for instance, in a herringbone pattern. Such small floorboards can be released by being pulled out along the long side so that the short sides snap out. The possibility of angling mainly long sides is most important for a well-functioning locking system. As a rule, taking-up starts in the first or last row of the installed floor.

FIGS. 5*a*-5*e* show manufacture of a laminate floor. FIG. 5*a* shows manufacture of high pressure laminate. A wear layer 34 of a transparent material with great wearing strength is impregnated with melamine with aluminum oxide added. A decorative layer 35 of paper impregnated with melamine is placed under this layer 34. One or more reinforcing layers 36*a*, 36*b* of core paper impregnated with phenol are placed under the decorative layer 35 and the entire packet is placed in a press where it cures under pressure and heat to an about 0.5-0.8 mm thick surface layer 31 of high pressure laminate. FIG. 5*c* shows how this surface layer 31 can then be glued together with a balancing layer 32 to a core 30 to constitute a floor element 3.

FIGS. 5*d* and 5*e* illustrate direct lamination. A wear layer 34 in the form of an overlay and a decorative layer 35 of decoration paper is placed directly on a core 30, after which all three parts and, as a rule, also a rear balancing layer 32 are placed in a press where they cure under heat and pressure to a floor element 3 with a decorative surface layer 31 having a thickness of about 0.2 mm.

After lamination, the floor element is sawn into floor panels. When the mechanical locking system is made in one piece with the core of the floorboard, the joint edges are formed in the subsequent machining to mechanical locking systems of different kinds which all lock the floorboards in the horizontal D2 and vertical D1 directions.

FIGS. 4*a-d* show in four steps manufacture of a floorboard. FIG. 4*a* shows the three basic components surface layer 31, core 30 and balancing layer 32. FIG. 4*b* shows a floor element 3 where the surface layer and the balancing layer have been applied to the core. FIG. 4*c* shows how floor panels 2 are made by dividing the floor element. FIG. 4*d* shows how the floor panel 2 after machining of its edges obtains its final shape and becomes a complete floorboard 1 with a locking system 7, 7', which in this case is mechanical, on the long sides 4*a*, 4*b*.

FIGS. 6*a*-8*b* show some common variants of mechanical locking systems which are formed by machining the core of the floorboard. FIGS. 6*a, b* illustrate a system which can be angled and snapped with excellent function. FIGS. 7*a, b* show a snap joint which cannot be opened. FIGS. 8*a, b* show a joint which can be angled and snapped but which has less strength and a poorer function than the locking system according to FIG. 6. As is evident from these Figures, the mechanical locking systems have parts which project past the upper joint edges and this causes expensive waste (w), owing to the removing of material performed by the sawblade SB when dividing the floor element and when surface material is removed and the core is machined in connection with the forming of the parts of the locking system.

These systems and the manufacturing methods suffer from a number of drawbacks which are related to, inter alia, cost and function.

The aluminum oxide and also the reinforcing layers which give the laminate floor its high wearing strength and impact resistance cause great wear on the tools the teeth of which consist of diamond. Frequent and expensive regrinding must be made particularly of the tool parts that remove the surface layer.

Machining of the joint edges causes expensive waste when core material and surface material are removed to form the parts of the locking system.

To be able to form a mechanical locking system with projecting parts, the width of the floorboard must usually be increased and the decoration paper in many cases be adjusted as to width. This may result in production problems and considerable investments especially when manufacturing parquet flooring.

A mechanical locking system has a more complicated geometry than a traditional locking system which is joined by gluing. The number of milling motors must usually be increased, which requires that new and more advanced milling machines be provided.

To satisfy the requirements as to strength, flexibility in connection with snapping-in and low friction in connection with displacement in the locked position, the core must be of high quality. Such quality requirements, which are necessary for the locking system, are not always necessary for the other properties of the floor, such as stability and impact strength. Owing to the locking system, the core of the entire floorboard must thus be of unnecessarily high quality, which increases the manufacturing cost.

To counteract these problems, different methods have been used. The most important method is to limit the extent of the projecting parts past the upper joint edge. This usually causes poorer strength and difficulties in laying or detaching the floorboards.

Another method is to manufacture parts of the locking system of another material, such as aluminum sheet or aluminum sections. These methods may result in great strength and good function but are as a rule significantly more expensive. In some cases, they may result in a somewhat lower cost than a machined embodiment, but this implies that floorboards are expensive to manufacture and that the waste is very costly, as may be the case when the floorboards are made of, for example, high quality high pressure laminate. In less expensive floorboards of low pressure laminate, the cost of these locking systems of metal is higher than in the case where the locking system is machined from the core of the board. The investment in special equipment, which is necessary to form and attach the aluminum strip to the joint edge of the floorboard, may be considerable.

It is also known that separate materials can be glued as an edge portion and formed by machining in connection with further machining of the joint edges. Gluing is difficult and machining cannot be simplified.

Floorboards can also be joined by means of separate loose clamps of metal which in connection with laying are joined with the floorboard. This results in laborious laying and the manufacturing costs are high. Clamps are usually placed under the floorboard and fixed to the rear side of the floorboard. They are not convenient for use in thin flooring. Examples of such clamps are described in DE 42 15 273 and U.S. Pat. No. 4,819,932. Fixing devices of metal are disclosed in U.S. Pat. No. 4,169,688, U.S. Pat. No. 5,295,341, DE 33 43 601 and JP 614,553. EP 1 146 182 discloses sections of thermoplastic which can snapped into the joint portion and which lock the floorboards by a snap function. All these alternatives have a poor function and are more expensive in manufacture and more difficult and, thus, more expensive to install than prior-art machined locking systems. WO 96/27721 discloses separate joint parts which are fixed to the floorboard by gluing. This is an expensive and complicated method.

OBJECTS AND SUMMARY

An object of the present invention is to eliminate or significantly reduce one or more of the problems occurring in connection with manufacture of floorboards with mechanical locking systems. This is applicable in particular to such floorboards with mechanical locking systems as are made in one piece with the core of the floorboard. A further object of the invention is to provide a rational and cost-efficient manufacturing method for manufacturing elements which are later to constitute parts of the mechanical locking system of the floorboards. A third object is to provide a rational method for joining of these elements with the joint portion of the floorboard to form an integrated mechanical locking system which locks vertically and horizontally. A fourth object is to provide a locking system which allows laying and taking-up of floorboards which are positioned between the first laid and the last laid rows of a joined floor. A fifth object is to provide a joint system and floorboards which can be laid by a vertical motion parallel to the vertical plane.

According to one aspect of the invention, parts of the mechanical locking system should preferably be made of a separate strip which may have other properties than the floorboard core, which does not contain expensive surface layers that are difficult to machine and which can be made of a board material thinner than the core of the floorboard. This makes it possible to reduce the amount of wasted material and the locking system can be given better properties specially adjusted to function and strength requirements on long side and short side.

The separate strip should also preferably be made of a sheet-shaped material which by mechanical working can be given its final shape in a cost-efficient manner and with great accuracy.

It should also preferably be possible to integrate the strip with the joint edge portion of the floorboard in a rational manner with great accuracy and strength, preferably by mechanical joining where a preferred alternative may involve snapping-in the core of the floorboard essentially parallel to the horizontal plane of the floorboard. The snapping-in, which can also be combined with an angular motion, should preferably be made by a change in shape of a groove in the joint edge portion of the floorboard. The mechanical joining between the floorboard and the separate strip should preferably enable a relative movement between the floorboard and the separate strip along the joint edge. In this way, it may be possible to eliminate tensions, in the cases where the floorboard and the strip move differently owing to the moisture and heat movements of different materials. The mechanical joining gives great degrees of freedom when selecting materials since there does not exist any gluing problem.

Machining of the edges of the floorboards can be made in a simpler and quicker manner with fewer and simpler tools which are both less expensive to buy and less expensive to grind, and that more advanced joint geometries can be provided if the manufacture of the locking system is made by machining a separate strip which can be formed of a sheet-shaped material with good machining properties. This separate strip can, after machining, be integrated with the floorboard in a rational manner.

The flexibility of the strip in connection with snapping-in of the floorboards against each other can be improved by the strip being made of a material which has better flexibility than the core of the floorboard and by the separate strip being able to move in the snap joint.

Several strips should be made in the same milling operation and that they should be made in such manner that they can be joined with each other to form a strip blank. In this way, the strips can be made, handled, separated and integrated with the floorboard in a rational and cost-efficient manner and with great accuracy.

The invention is especially suited for use in floorboards whose locking system comprises a separate strip which is machined from a sheet-shaped material, preferably containing wood fibers, for instance particle board, MDF, HDF, compact laminate, plywood and the like. Such board materials can be machined rationally and with great accuracy and dimensional stability. HDF with high density, for instance about 900 kg/m.sup.3 or higher, and compact laminate consisting of wood fibers and thermosetting plastics, for instance phenol, are most convenient as semimanufactures for manufacturing strip blanks. The above-mentioned board materials can also by, for instance, impregnation with suitable chemicals in connection with the manufacture of the board material or alternatively before or after machining, when they have been formed to strip blanks or strips. They can be given improved properties, for instance regarding strength, flexibility, moisture resistance, friction and the like. The strips can also be colored for decoration. Different colors can be used for different types of floors. The board material may also consist of different plastic materials which by machining are formed to strips. Special board materials can be made by gluing or lamination of, for instance, different layers of wood fiberboards and plastic material. Such composite materials can be adjusted so as to give, in connection with the machining of the strips, improved properties in, for instance, joint surfaces which are subjected to great loads or which should have good flexibility or low friction. It is also possible to form strips as sections by extrusion of thermosetting plastic, composite sections or metal, for instance aluminum, but as a rule this will be more expensive than machining. The rate of production is only a fraction of the rates that can be achieved in modern working machines.

The strips may consist of the same material as the core of the floorboard, or of the same type of material as the core, but of a different quality, or of a material quite different from that of the core.

The strips can also be formed so that part thereof is visible from the surface and constitutes a decorative portion.

The strips can also have sealing means preventing penetration of moisture into the core of the floorboard or through the locking system. They can also be provided with compressible flexible layers of, for instance, rubber material.

The strips can be positioned on long side and short side or only on one side. The other side may consist of some other traditional or mechanical locking system. The locking systems can be mirror-inverted and they can allow locking of long side against short side.

The strips on long side and short side can be made of the same material and have the same geometry, but they may also consist of different materials and have different geometries. They can be particularly adjusted to different requirements as to function, strength and cost that are placed on the locking systems on the different sides. The long side contains, for example, more joint material than the short side and is usually laid by laying. At the short side the strength requirements are greater and joining often takes place by snapping-in which requires flexible and strong joint materials.

As mentioned above, inward angling of above all long sides is of great importance. A joint system allowing inward angling and upward angling requires as a rule a wide strip which causes much waste when manufactured. Thus, the invention is specially suited for joint systems that can be angled along upper joint edges.

The shape of the floorboard can be rectangular or square. The invention is particularly suited for narrow floorboards or floorboards having the shape of, e.g., parquet blocks. Floors with such floorboards contain many joints and separate joint parts then yield great savings. The invention is also particularly suited for thick laminate flooring, for instance 10-12 mm, where the cost of waste is high and about 15 mm parquet flooring with a core of wooden slats, where it is difficult to form a locking system by machining wood material along and transversely of the direction of the fibers. A separate strip can give considerable advantages as to cost and a better function.

It is also not necessary for the strip to be located along the entire joint edge. The long side or the short side can, for instance, have joint portions that do not contain separate joint parts. In this manner, additional cost savings can be achieved, especially in the cases where the separate strip is of high quality, for instance compact laminate.

The separate strip may constitute part of the horizontal and vertical joint, but it may also constitute merely part of the horizontal or the vertical joint.

The various aspects of the invention below can be used separately or in an optional combination. Thus, a number of combinations of different locking systems, materials, manufacturing methods and formats can be provided. It should be particularly pointed out that the mechanical joining between the floorboard and the separate strip may also consist of a glue joint which improves joining. The mechanical joining can then, for instance, be used to position the joint part and/or to hold it in the correct position until the glue cures.

According to a first aspect of the invention, a locking system for mechanical joining of floorboards is thus provided, where immediately juxtaposed upper parts of two neighboring joint edges of two joined floorboards together define a vertical plane which is perpendicular to the principal plane of the floorboards. To perform joining of the two joint edges in the horizontal direction perpendicular to the vertical plane and parallel to the horizontal plane, the locking system comprises in a manner known per se a locking groove formed in the joint edge portion and extended parallel to the first joint edge, and a separate strip which is integrated with the second joint edge and which has a projecting portion which at a distance from the vertical plane supports a locking element coacting with the locking groove, said projecting portion thus being located completely outside the vertical plane seen from the side of the second joint edge. The locking system according to this aspect of the invention is characterized in that the separate strip is formed by machining a sheet-shaped material, the separate strip with its projecting portion is joined with the core of the floorboard using a mechanical snap joint which joins and locks the separate strip with the floorboard in the horizontal and vertical direction, that snapping-in can take place by relative displacement of the strip and the joint edge of the floorboard towards each other.

According to a first embodiment of this first aspect, a floorboard with the above joint system is provided, characterized by the combination that the strip consists of HDF, snapping-in can take place against a groove in the joint edge portion of the floorboard, this groove being changed in shape in connection with snapping-in, the floorboard has at least two opposite sides which can be joined or released by an angular motion along the joint edge.

According to a second aspect of the invention, a strip blank is provided, which is intended as semimanufacture for making floorboards with a mechanical locking system which locks the floorboards vertically and horizontally. The strip blank consists of a sheet-shaped blank intended for machining, characterized in that said strip blank consists of at least two strips which constitute the horizontal joint in the locking system.

According to a third aspect of the invention, there is provided a method of providing rectangular floorboards, which have machined joint portions, with a mechanical locking system which locks the floorboards horizontally and vertically on at least two opposite sides, said locking system consisting of at least one separate strip, characterized in that the strip is made by machining of a sheet-shaped material, the strip is joined with the joint portion mechanically in the horizontal direction and in the vertical direction perpendicular to the principal plane, the mechanical joining takes place by snapping-in relative to the joint edge.

According to a fourth aspect of the invention, there is provided a floorboard with a vertical joint in the form of a tongue and a groove, the tongue consisting of a separate material and being flexible so that at least one of the sides of the floorboard can be joined by a vertical motion parallel to the vertical plane.

According to a fifth aspect of the invention, there are provided floorboards which can be taken up and laid once more in a laid floor and wherein these floorboards are joined to other floorboards in the portions of the floor which are located between the outer portions of the floor.

BRIEF DESCRIPTION OF THE DRAWINGS

FIGS. 15*a-d* show a production-adjusted embodiment of the invention and joining of floorboards by inward angling and snapping-in.

DESCRIPTION OF PREFERRED EMBODIMENTS

A first preferred embodiment of a floorboard 1,1' provided with a mechanical locking system according to the invention will now be described with reference to FIGS. 9*a-d*. To facilitate understanding, the locking system is shown schematically. It should be emphasized that an improved function can be achieved using other preferred embodiments that will be described below.

Figure 2A:
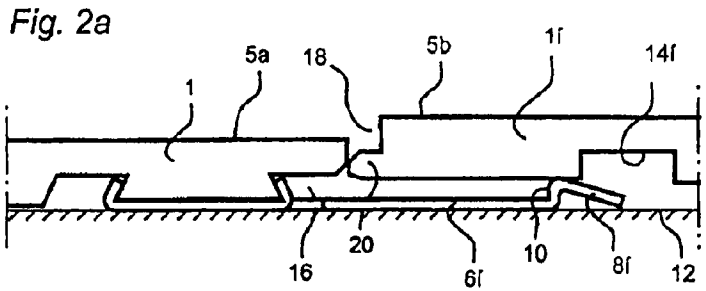
FIGS. 2*a-c* illustrate in different steps conventional mechanical joining of floorboards.
Figure 2B:
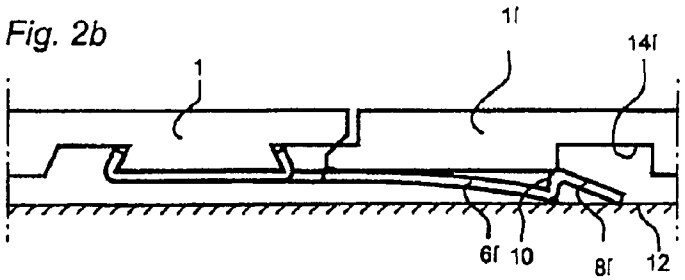
Figure 2C:
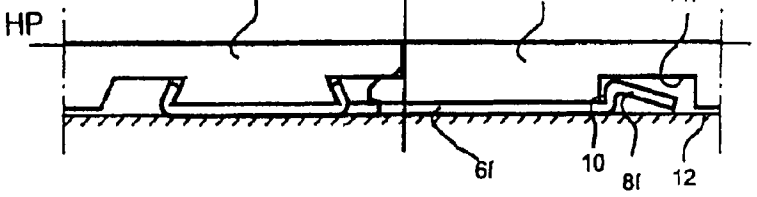
Fig. 2c PRIOR ART
Figure 1A:
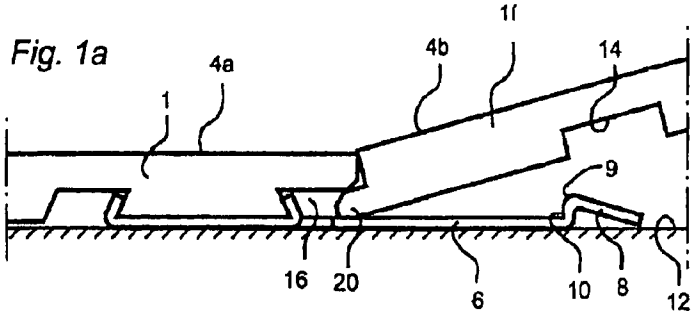
FIGS. 1*a-c* illustrate in different steps conventional mechanical joining of floorboards.
Figure 1B:
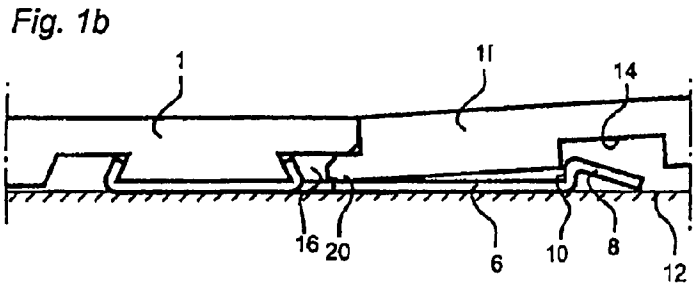
Figure 1C:
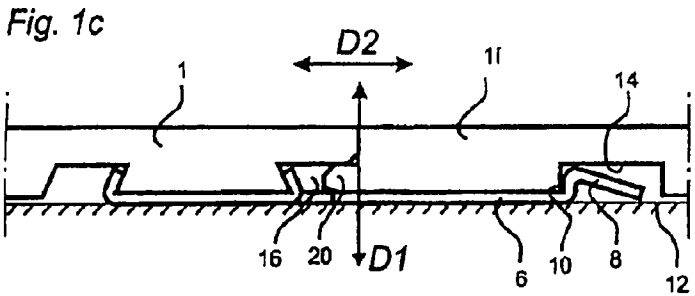
Fig. 1c PRIOR ART
Figure 3A:
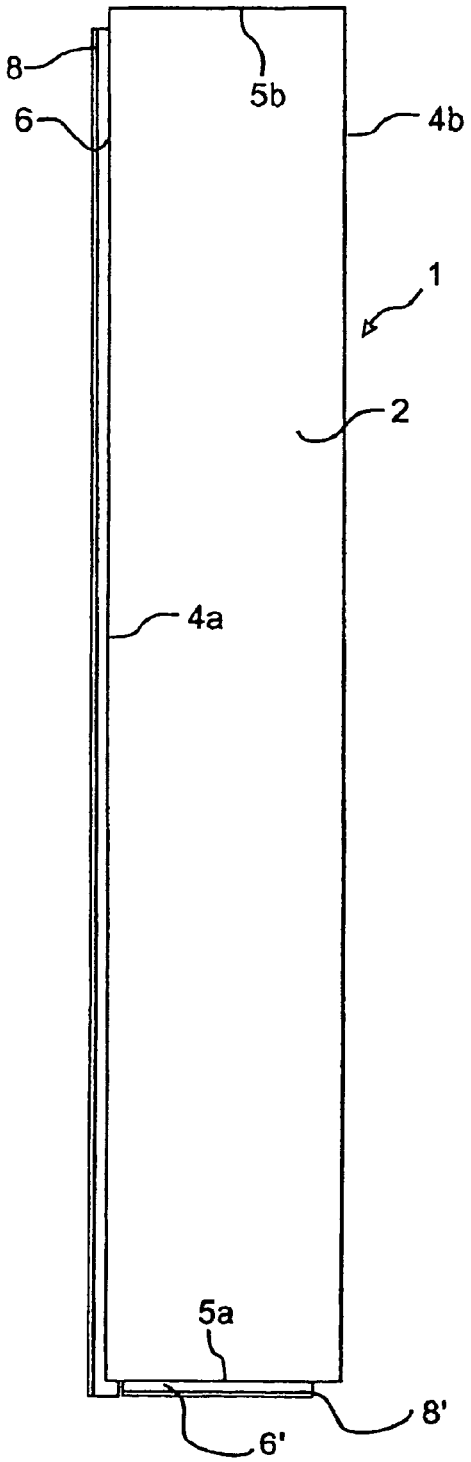
FIGS. 3*a-b* show floorboards with a conventional mechanical locking system.
Figure 3B:
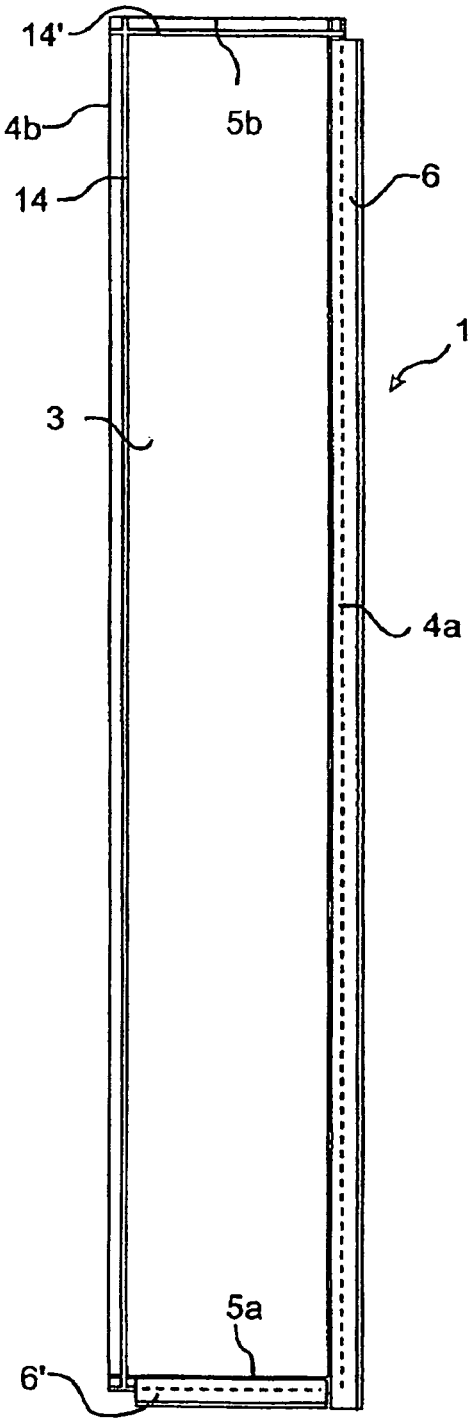
Figure 4A:
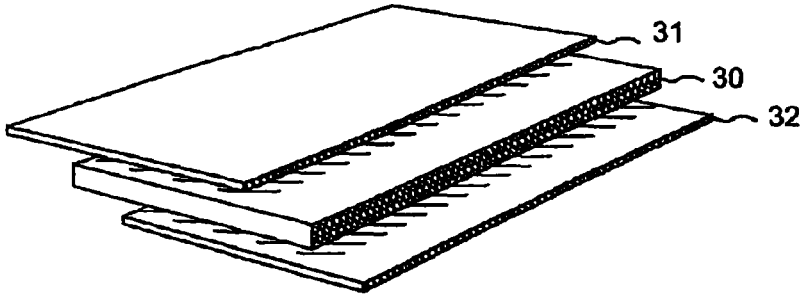
FIGS. 4*a-d* show manufacture of conventional laminate flooring.
Figure 4B:
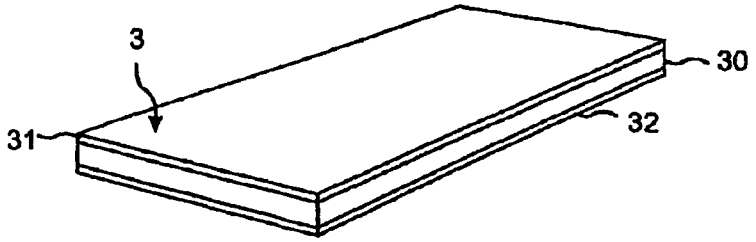
Figure 4C:
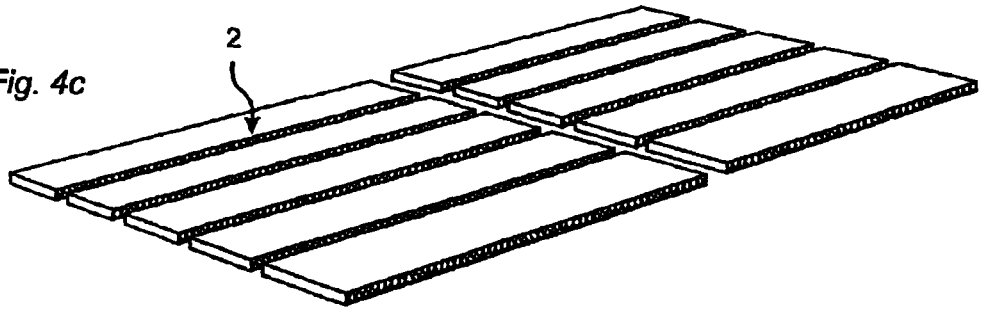
Figure 4D:
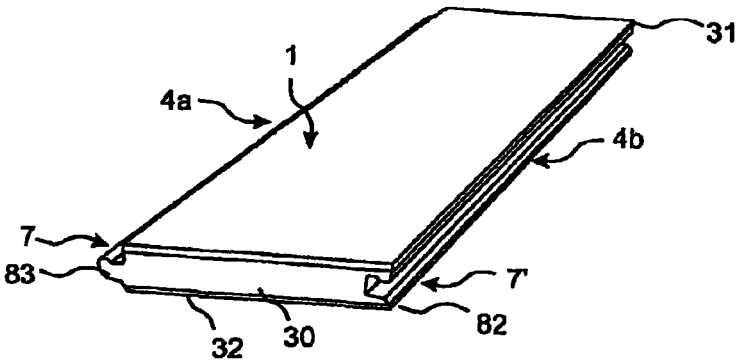
Figure 5A:
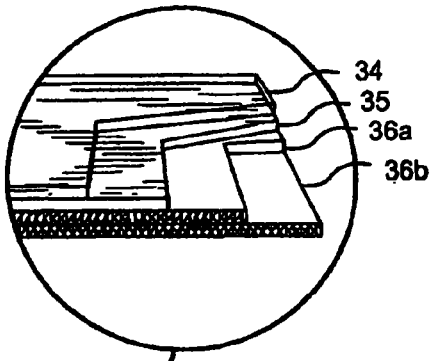
FIGS. 5*a-e* show manufacture of conventional laminate flooring.
Figure 5B:
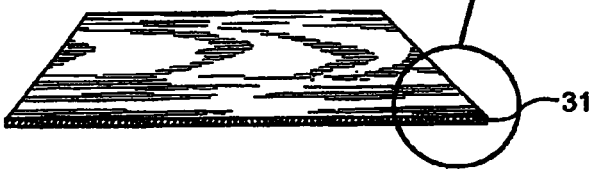
Figure 5C:
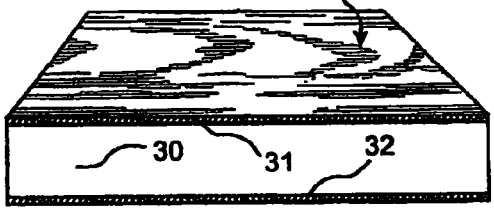
Figure 5D:
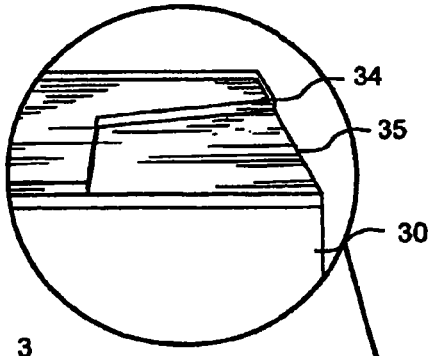
Figure 5E:
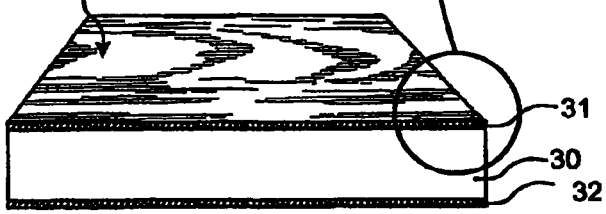
Figure 6A:
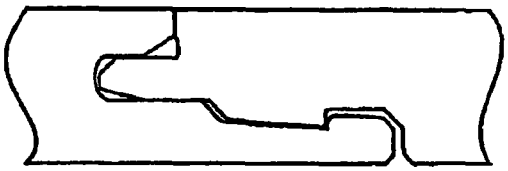
FIGS. 6*a-b* show a conventional mechanical locking system.
Figure 6B:
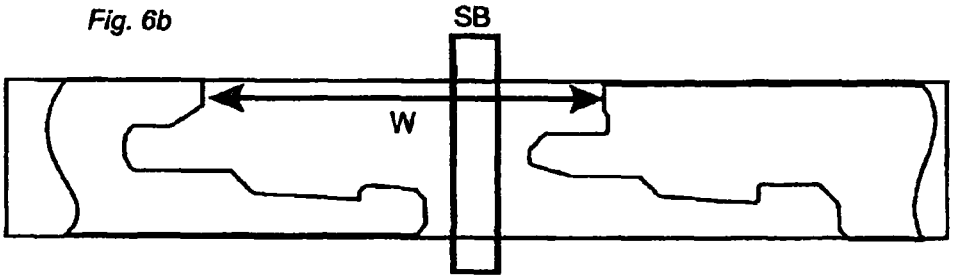
Figure 7A:
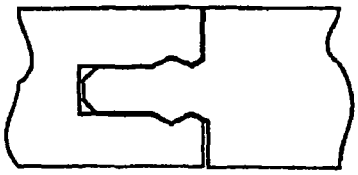
FIGS. 7*a-b* show another conventional mechanical locking system.
Figure 7B:
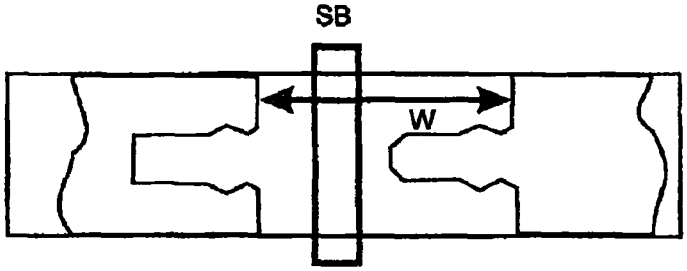
Figure 8A:
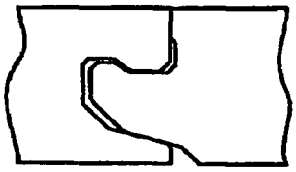
FIGS. 8*a*-8*b* show a third embodiment of conventional mechanical locking systems.
Figure 8B:
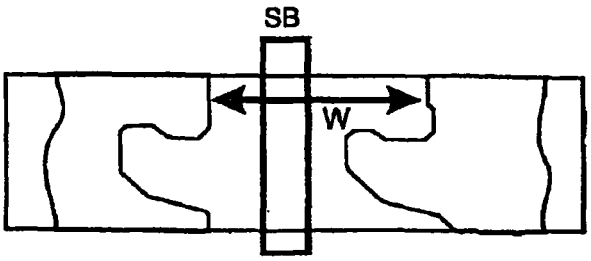
Figure 9A:
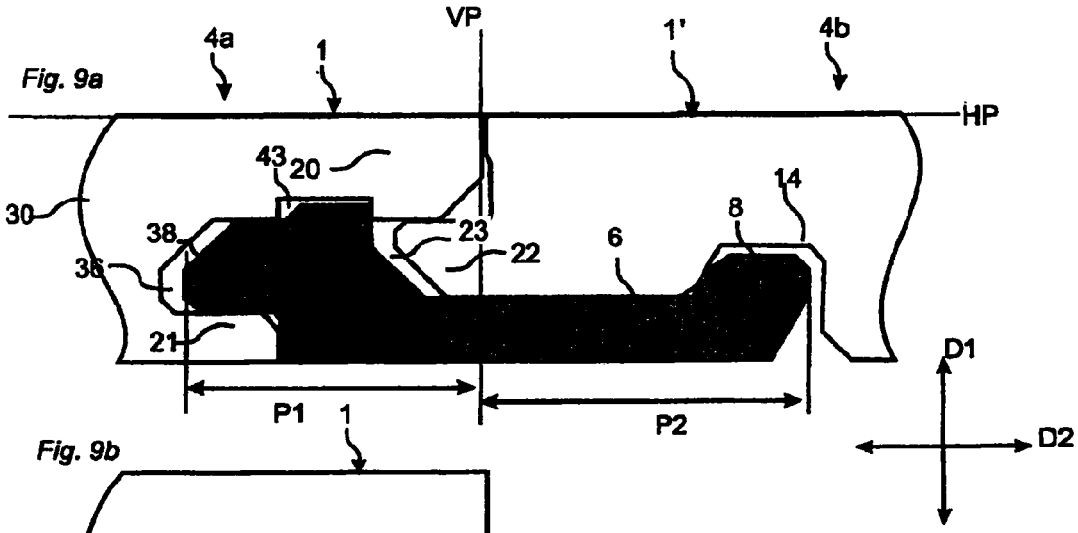
FIGS. 9*a-d* illustrate schematically an embodiment of the invention.
Figure 9B:
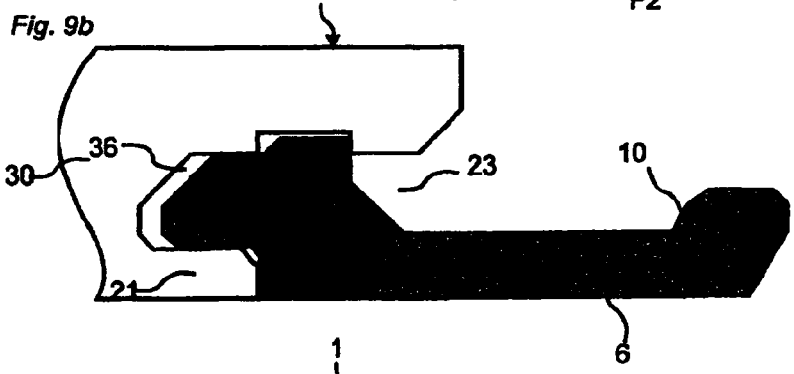

FIG. 9*a* illustrates schematically a cross-section through a joint between a long side edge portion 4*a* of a board 1 and an opposite long side edge portion 4*b* of a second board 1'.

The upper or front sides of the boards are essentially positioned in a common horizontal plane HP, and the upper parts of the joint edge portions 4*a*, 4*b* abut against each other in a vertical plane VP. The mechanical locking system provides locking of the boards relative to each other in the vertical direction D1 as well as the horizontal direction D2.

To provide joining of the two joint edge portions in the D1 and D2 directions, the edges of the floorboard have a tongue groove 23 in one edge portion 4*a* of the floorboard and a tongue 22 formed in the other joint edge portion 4*b* and projecting past the vertical plane VP.

In this embodiment, the board 1 has a body or core 30 of wood-fiber-based material.

The mechanical locking system according to the invention comprises a separate strip 6 which has a projecting portion P2 projecting past the vertical plane VP and having a locking element 8. The separate strip also has an inner part P1 which is positioned inside the vertical plane VP and is mechanically joined with the floorboard 1. The locking element 8 coacts in prior-art manner with a locking groove 14 in the other joint edge portion and locks the floorboards relative to each other in the horizontal direction D2.

The floorboard 1 further has a strip groove 36 in one joint edge portion 4*a* of the floorboard and a strip tongue 38 in the inner part P1 of the separate strip 6.

The strip groove 36 is defined by upper and lower lips 20, 21 and has the form of an undercut groove 43 with an opening between the two lips 20, 21.

Figure 9C:
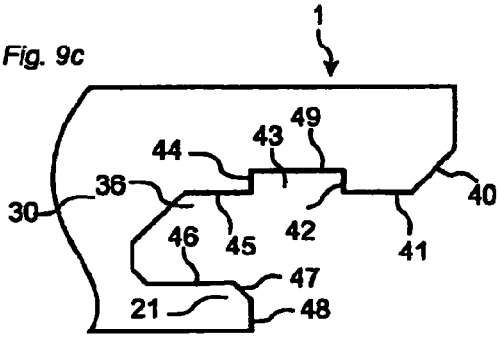

The different parts of the strip groove 36 are best seen in FIG. 9*c*. The strip groove is formed in the body or core 30 and extends from the edge of the floorboard. Above the strip groove there is an upper edge portion or joint edge surface 40 which extends all the way up to the horizontal plane HP. Inside the opening of the strip groove there is an upper engaging or supporting surface 41, which in the case is parallel to the horizontal plane HP. This engaging or supporting surface passes into a locking surface 42. Inside the locking surface there is a surface portion 49 forming the upper boundary of the undercut portion 33 of the strip groove and a surface 44 forming the bottom of the undercut groove. The strip groove further has a lower lip 21. On the upper side of this lip there is an engaging or supporting surface 46. The outer end of the lower lip has a lower joint edge surface 47 and a positioning surface 48. In this embodiment, the lower lip 21 does not extend all the way to the vertical plane VP.

Figure 9D:
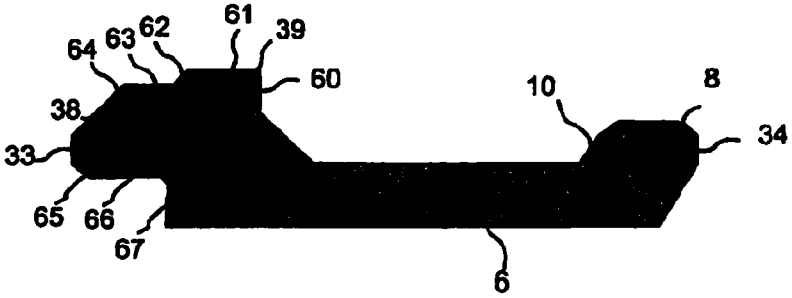

The shape of the strip tongue is also best seen in FIG. 9*d*. In this preferred embodiment, the strip tongue is made of a wood-based board material, for instance HDF.

The strip tongue 38 of the separate strip 6 has a strip locking element 39 which coacts with the undercut groove 43 and locks the strip onto the joint edge portion 4*a* of the floorboard 1 in the horizontal direction D2. The strip tongue 38 is joined with the strip groove by means of a mechanical snap joint. The strip locking element 39 has a strip locking surface 60 facing the vertical plane VP, an upper strip surface 61 and an inner upper guiding part 62 which in this embodiment is inclined. The strip tongue also has an upper engaging or supporting surface 63, which in this case extends all the way to an inclined upper strip tongue part 64 at the tip of the tongue. The strip tongue further has a lower guiding part 65 which in this embodiment passes into a lower engaging or supporting surface 66. The supporting surface passes into a lower positioning surface 67 facing the vertical plane VP. The upper and lower engaging surfaces 45, 63 and 46, 66 lock the strip in the vertical direction D1. The strip 6 is in this embodiment made of a board material containing wood fibers, for instance HDF.

Figure 10A:
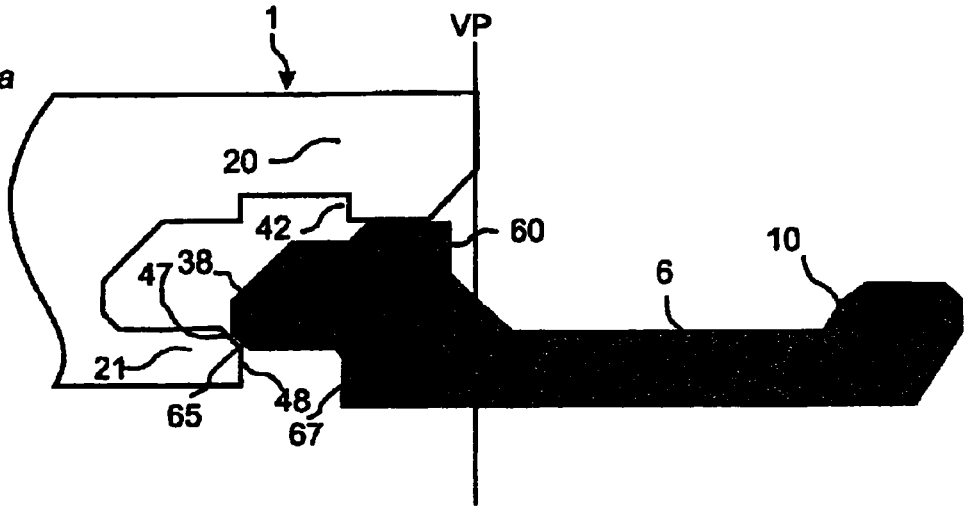
FIGS. 10*a-c* show schematical joining of a separate strip with a floorboard according to an embodiment of the invention.
Figure 10B:
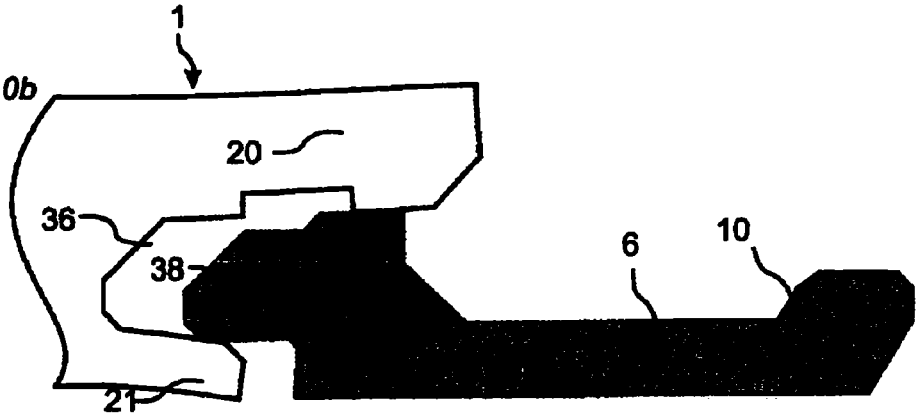
Figure 10C:
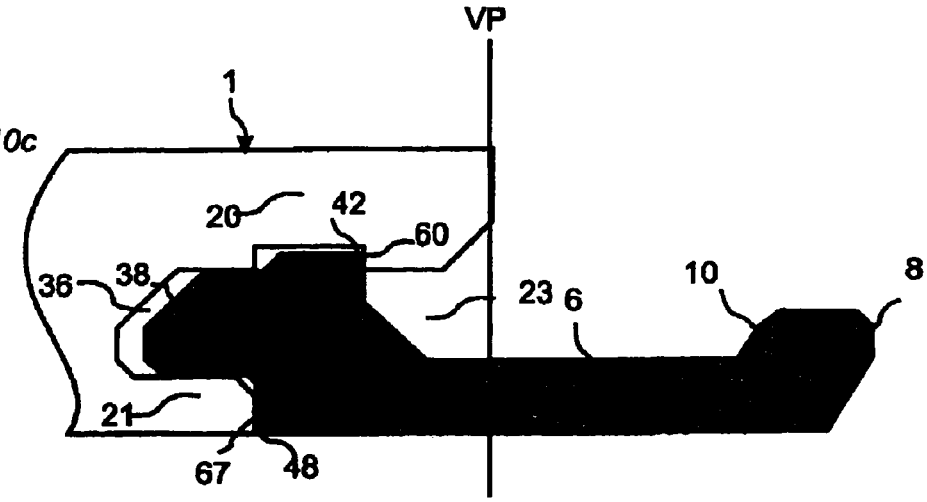

FIGS. 10*a-c* illustrate schematically how the separate strip 6 is integrated with the floorboard 1 by snap action. When the floorboard 1 and the strip 6 are moved towards each other according to FIG. 10*a*, the lower guiding part 65 of the strip tongue will coact with the joint edge surface 47 of the lower lip 21. According to FIG. 10*b*, the strip groove 36 opens by the upper lip 20 being bent upwards and/or the lower lip 21 downwards. The strip 6 is moved until its positioning surface 67 abuts against the positioning surface 48 of the lower lip. The upper and the lower lip 20, 21 snap backwards and the locking surfaces 42, 60 lock the strip 6 into the floorboard 1 and prevent separation in the horizontal direction. The strip tongue 38 and the strip groove 36 prevent separation in the vertical direction D1. The locking element 8 and its locking surface 10 will by this type of snap motion be exactly positioned relative to the upper joint edge of the floorboard and the vertical plane VP. Thus, by this snap motion the floorboard has been integrated with a machined strip which in this embodiment is made of a separate sheet-shaped and wood-fiber-based material.

Figures 11A, 11B, 11C, 12A, 12B, 12C, 13:
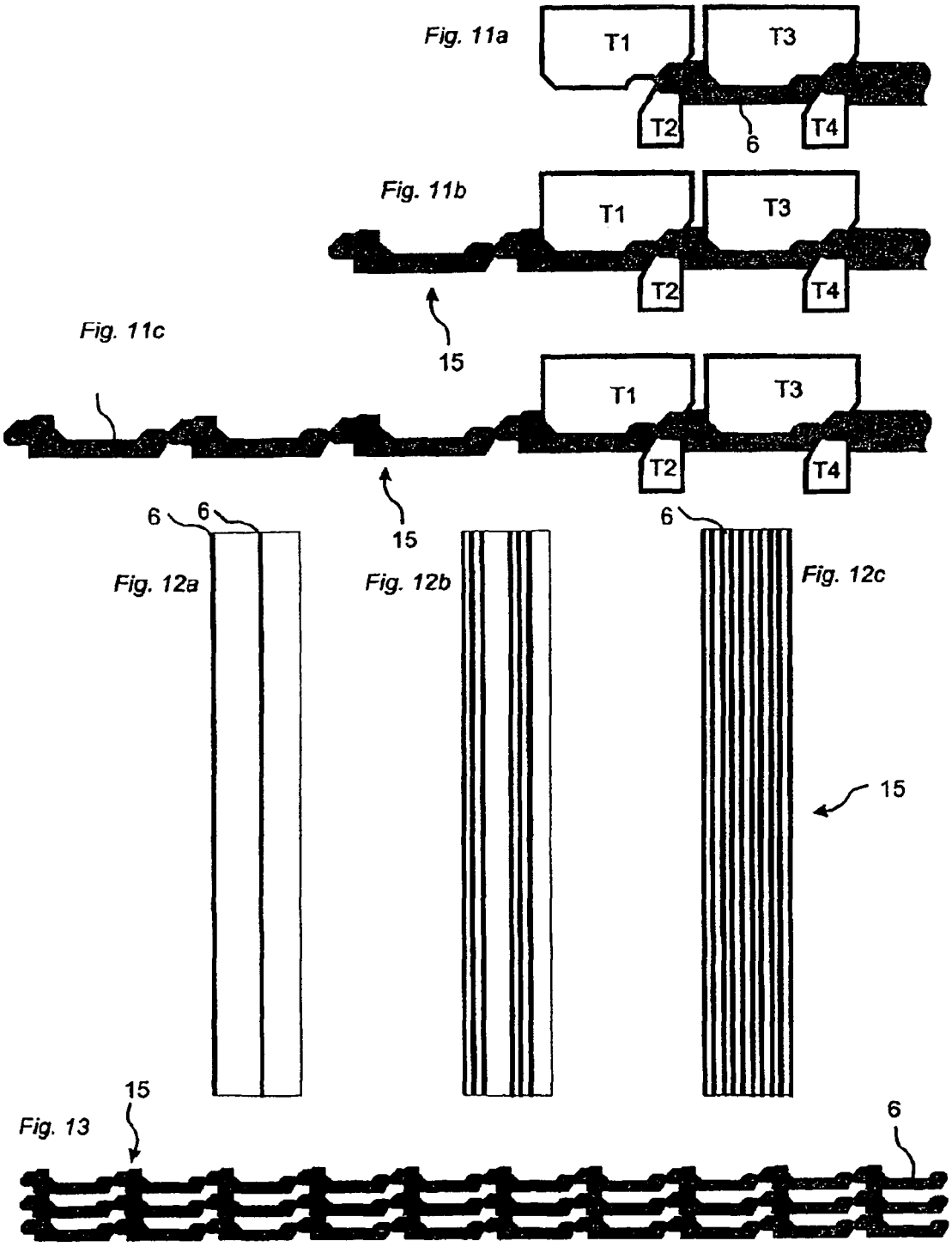
FIGS. 11*a-c* illustrate machining of strip blanks according to an embodiment of the invention.
FIGS. 12*a-c* show how a strip blank is made in a number of manufacturing steps according to an embodiment of the invention.
FIG. 13 shows how a plurality of strip blanks can be handled according to an embodiment of the invention.
Figure 14A:
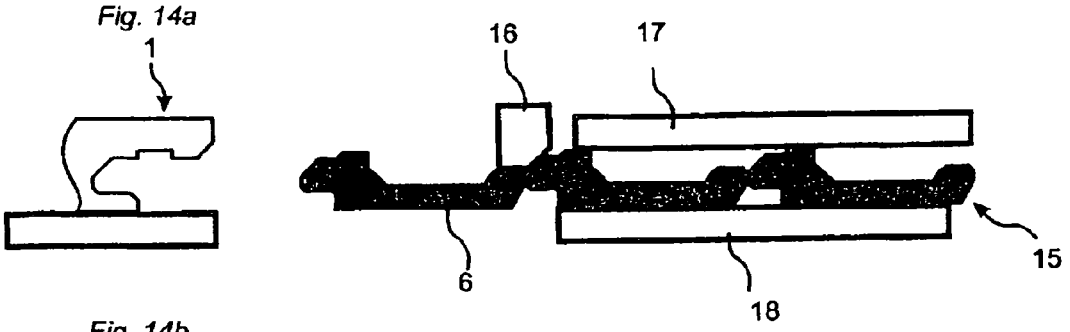
FIGS. 14*a-d* show how the separate strip is joined with the floorboard and separated from the strip blank according to an embodiment of the invention.
Figure 14B:
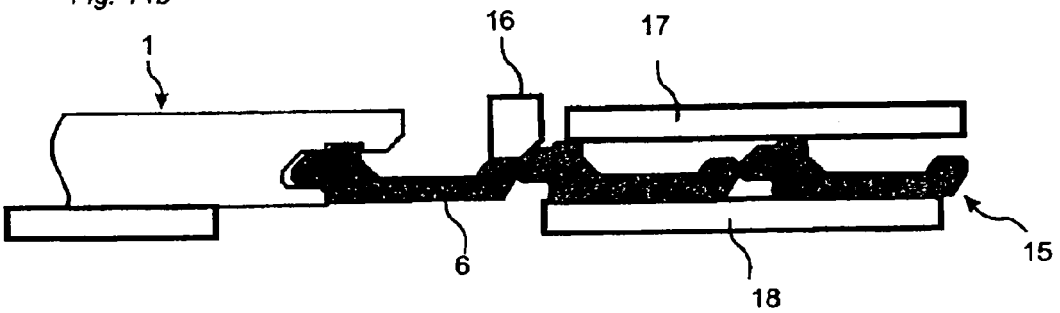
Figure 14C:
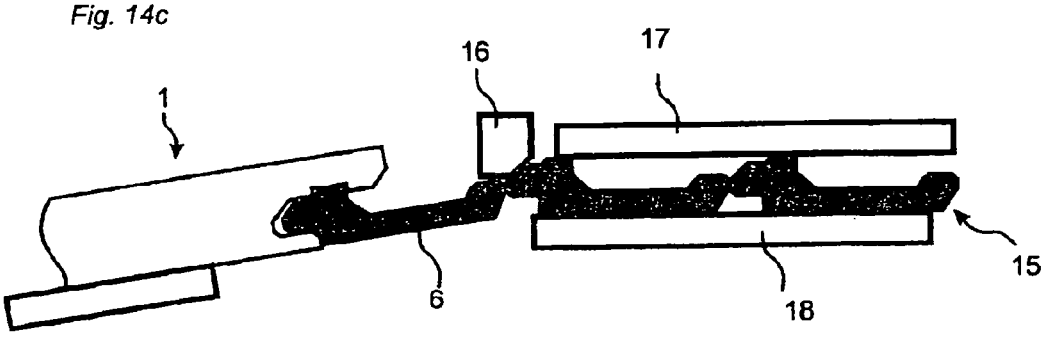
Figure 14D:
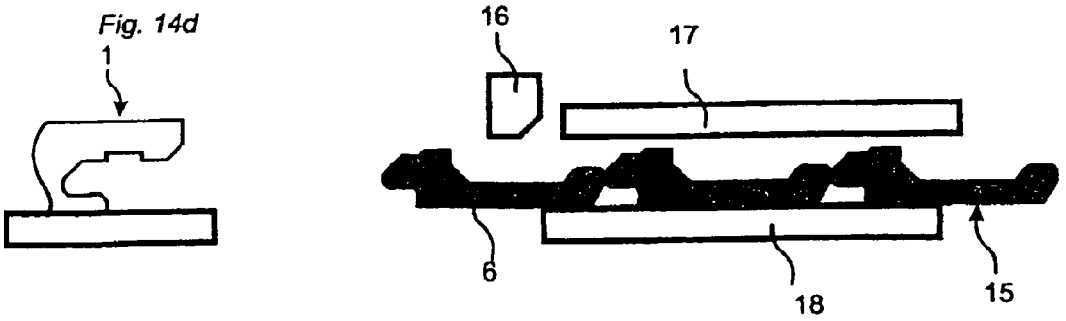

FIGS. 11*a-c* show how a strip blank 15 consisting of a plurality of strips 6 is made by machining. T1-T4 indicate machining tools, preferably of diamond type, operating from above and from below. Only two tools T1 and T2 are necessary to produce a strip 6. In the first manufacturing step according to FIG. 11*a*, a strip 6 is made. However, this strip is not separated from the strip blank. In the next machining, the strip blank 15 is moved sideways a distance corresponding to the width of two strips. In the third manufacturing step, this step is repeated and now two more strips are manufactured. The strip blank thus grows by two strips in each run through the machine. FIGS. 12*a-c* show how the strip blank 15 with a plurality of strips 6 can be manufactured in a double-sided milling machine with four tools on each side. In the first manufacturing step according to FIG. 12*a*, two strips are manufactured. In the next manufacturing step, FIG. 12*b*, four more strips are manufactured. FIG. 12*c* shows that the strip blank consists of 10 strips after three steps. With a double-sided machine, which has, for instance, 8 milling motors and 8 tools on each side, 8 strips can be made in each run through the milling machine. Since machining can take place in, e.g., HDF which does not have a surface layer, machining speeds of up to 200 m/min can be achieved with 8 strips in each run. Since normal flooring lines machine the joint edges by about 100 m/min, such a line can provide 16 flooring lines with strip blanks. The strips are made of a board material which can be considerably thinner than the floorboard. The cost of a separate strip with a width of 15-20 mm, made of an HDF board having a thickness of, for instance, 5 mm, is less than 30% of the waste cost in machining an 8 mm laminate floorboard with an integrated strip which has an extent outside the joint edge corresponding to about 8-10 mm.

Several variants may appear. The strip blank can be manufactured in conventional planing machines. Special machines can be used, consisting of, for instance, a lower and an upper shaft with tools operating vertically. The floorboard is advanced by means of rolls which press the floorboard against vertical and lateral abutments and against the rotating tools.

According to an embodiment of the present invention, the separate strip is made by mechanical working of a sheet-shaped material.

FIG. 13 shows a plurality of strip blanks which can be stacked and handled rationally. It is possible to manufacture strip blanks which have a length which is the same as the length and width of the floorboard and which consist of 10-20 strip blanks or more. The length of the strips may vary, for instance, between 70 and 2400 mm. The width can be, for example, about 10-30 mm. The strips can be manufactured with fracture lines for separating the strips. In HDF, such fracture lines can be made so that the material thickness amounts to merely, for instance, about 0.5 mm. The strip blanks can then be joined with, for instance, lines of hot-melt adhesive to long strips which are then rolled up.

FIGS. 14*a-d* show a manufacturing method for integrating the strip with the floorboard. The strip blank 15 is fed between upper and lower supports 17, 18 towards a stop member 16 so that the strip 6 will be correctly positioned. The floorboard 1 is moved towards the strip according to FIG. 14*b* so that snapping-in takes place. Then the strip 6 is separated from the strip blank 15, for instance, by the strip being broken off. Subsequently this manufacturing step is repeated according to FIG. 14*b*. The equipment required for this snapping-in is relatively simple, and manufacturing speeds corresponding to normal flooring lines can be obtained. The strip 6 can in this manner be snapped onto both long side and short side. It is obvious that a number of variants of this manufacturing method are feasible. The strip 6 can be moved towards the floorboard at different angles. Snapping-in can be combined with an angular motion. Inward angling with a minimum of, or no, snapping-in can also be used. The strip can be attached when the board does not move or when it moves. In the latter case, part of the strip is pressed against the joint edge portion of the floorboard close to a corner between a long side and a short side. After that the remaining part of the strip can be rolled, pressed or angled in against the joint edge. Combinations of one of more of these methods can be used within one side or between different sides. The strip can be separated in a number of other ways, for instance, by cutting off, sawing etc, and this can also take place before fastening.

Figure 15A:
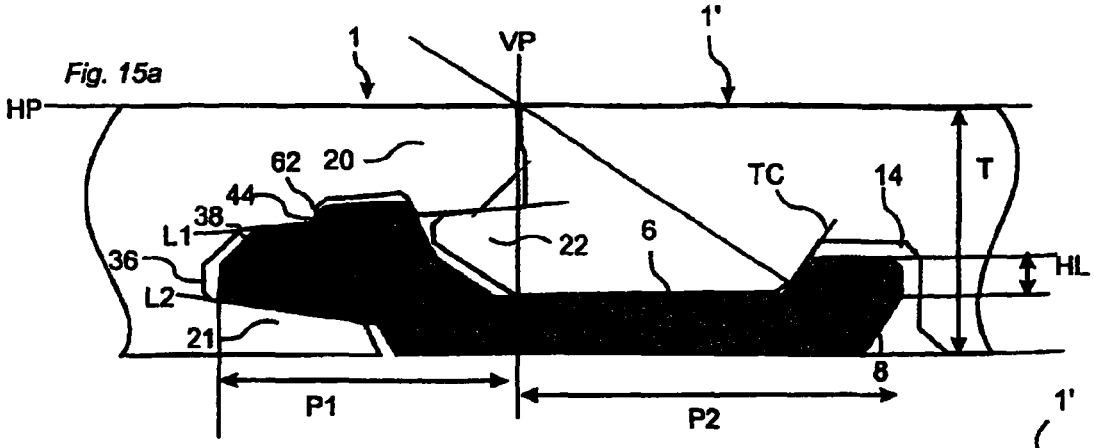
Figure 15B:
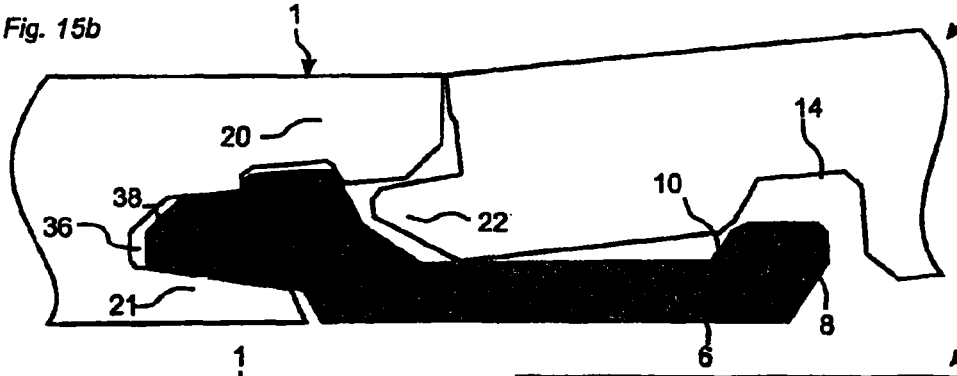
Figure 15C:
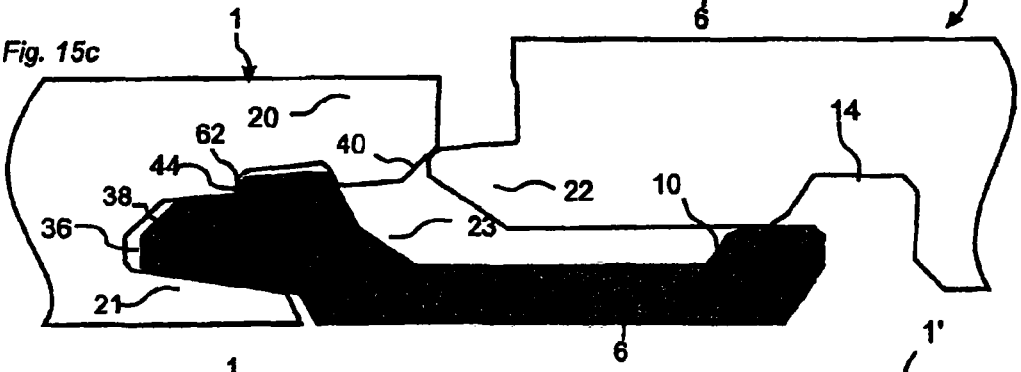
Figure 15D:
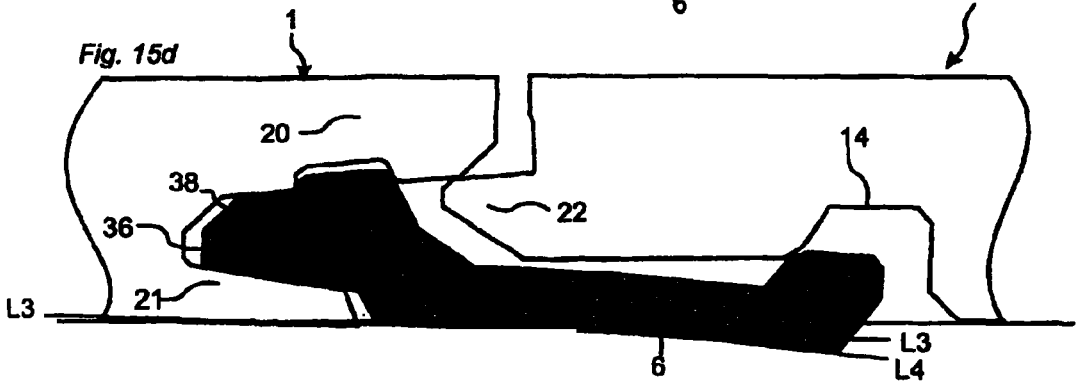
Figure 16A:
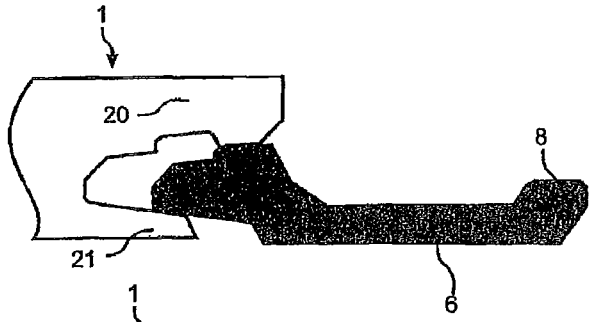
FIGS. 16*a-d* show joining of a production-adjusted separate strip blank with the floorboard by snap action according to an embodiment of the invention.
Figure 16B:
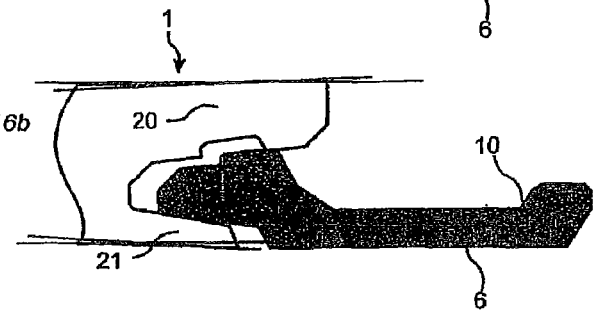
Figure 16C:
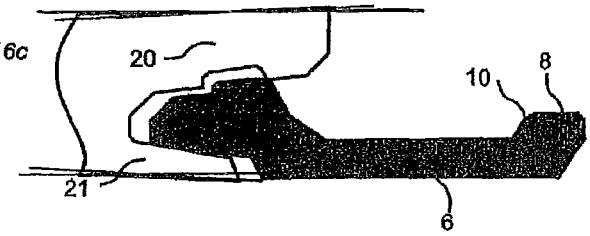
Figure 16D:
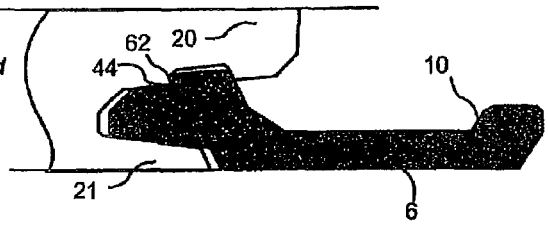

FIGS. 15*a-d* show a production-adjusted variant of the invention. In this embodiment, the upper and lower lips 20, 21 of the strip groove 36 as well as the upper and lower engaging surfaces 63, 66 of the strip tongue are inclined relative to the horizontal plane HP and they follow lines L1 and L2. This significantly facilitates snapping the strip into the floorboard 1. The lower lip 21 has been made longer and the locking element of the strip and the locking surface of the undercut groove are inclined. This facilitates manufacture and snapping-in. In this embodiment, the positioning of the strip in connection with snapping-in takes place by part of the upper guiding part 62 coacting with the bottom 44 of the undercut groove. The locking element 14 has a locking surface 10 which has the same inclination as the tangent TC to the circular arc with its center in the upper joint edge. Such an embodiment facilitates inward angling but requires that the projecting portion P2 should have an extent which is preferably the same size as the thickness T of the floorboard for the locking surface of the locking element to have a sufficiently high angle relative to the underside of the board. A high locking angle increases the locking capability of the locking system. The separate strip allows joint geometries with an extended projecting portion P2 without this causing greater costs in manufacture. An extended inner part P1 facilitates integration by snap action and results in high fastening capability. The following ratios have been found particularly favorable. P2>T and P1>0.5 T. As a non-restrictive example, it can be mentioned that a satisfactory function can be achieved even when P2 is 0.8*T or greater. FIG. 15*b* shows inward angling with a play between the locking element 8 and the locking groove 14 during the initial phase of the inward angling when the upper joint edges touch each other and when parts of the lower part of the locking groove 14 are lower than the upper part of the locking element 8. FIG. 15*d* shows snapping-in of the floorboard 1' into the floorboard 1. A separate strip 6 which is mechanically integrated with the floorboard 1 facilitates snapping-in by the strip 6 being able to move in a rotary motion in the strip groove 36. The strip can then turn as indicated by line L3. The remaining displacement downwards of the locking element 8 to the position L4 can be effected by downward bending of the strip 6. This makes it possible to provide locking systems which are capable of snapping and angling on long side as well as short side and which have a relatively high locking element 8. In this way, great strength and good capability of inward angling can be combined with the snap function and a low cost. The following ratio has been found favorable. HL>0.15 T. This can also be combined with the above ratios.

FIGS. 16*a-d* show snapping-in of the strip 6 in four steps. As is evident from the Figures, the inclined surfaces allow the snapping-in of the strip 6 into the floorboard 1 to be made with a relatively small bending of the upper and lower lips 20 and 21.

Figure 17:
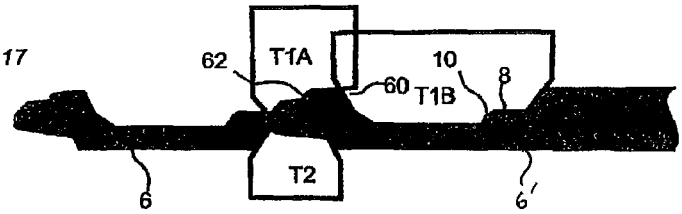
FIG. 17 illustrates a preferred alternative of how the separate strip is made by machining according to an embodiment of the invention.
Figure 18A:
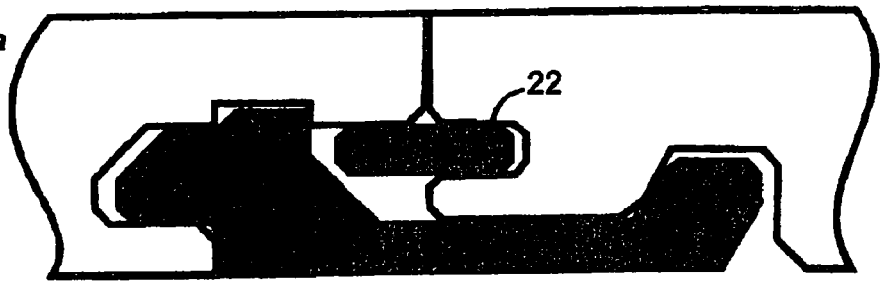
FIGS. 18*a-d* illustrate a preferred embodiment according to the invention with a separate strip and tongue.
Figure 18B:
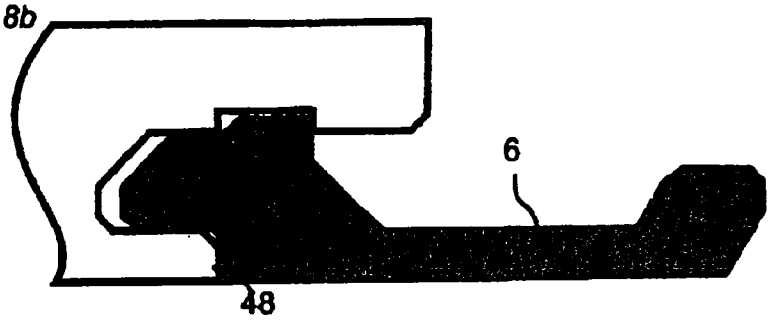
Figure 18C:
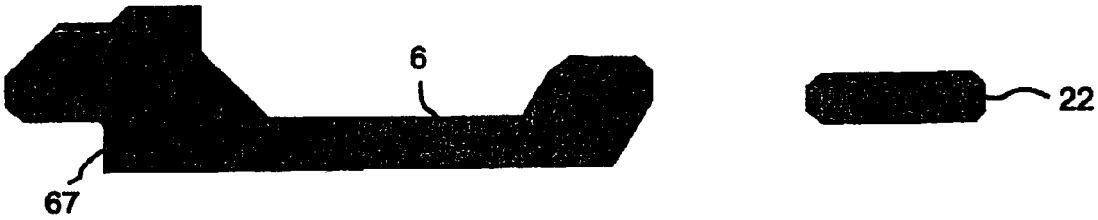
Figure 18D:
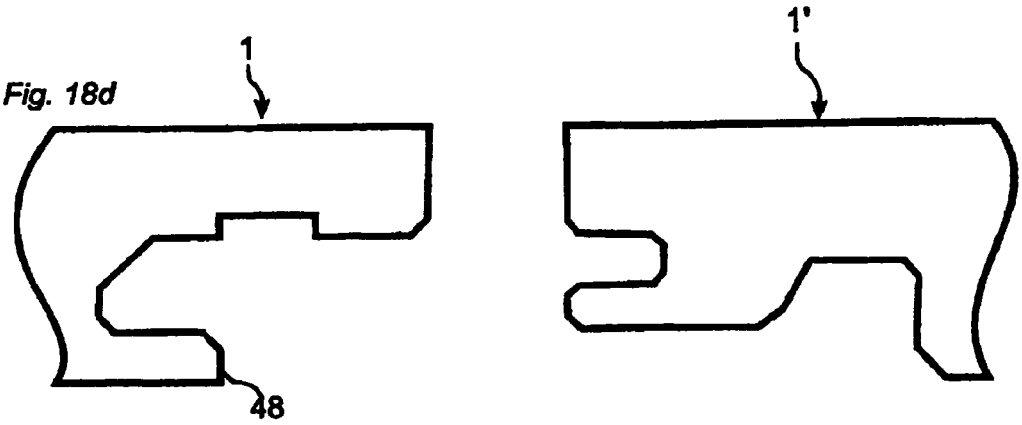
Figure 19A:
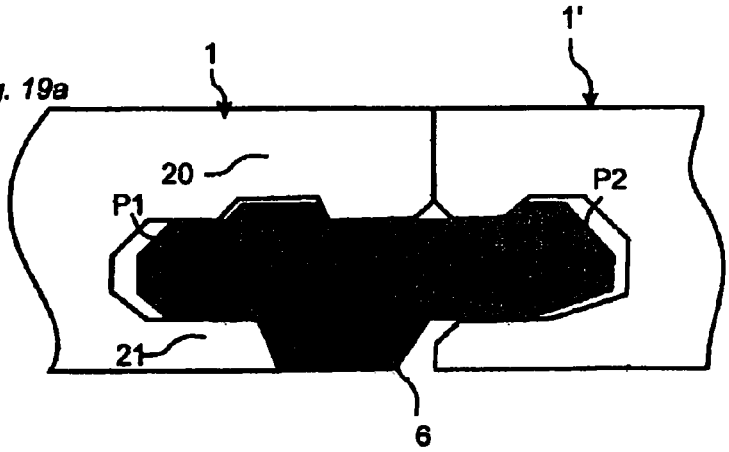
FIGS. 19*a-d* illustrate a preferred embodiment according to the invention.
Figure 19B:
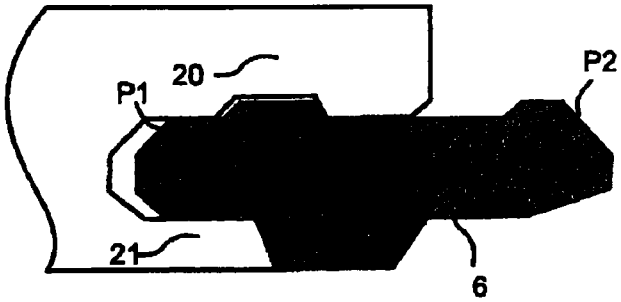
Figure 19C:
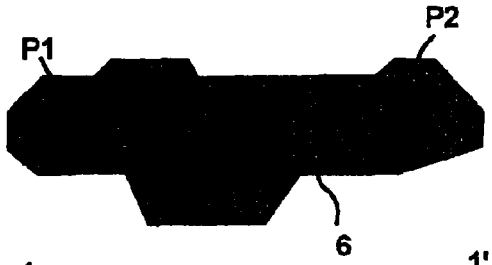
Figure 19D:
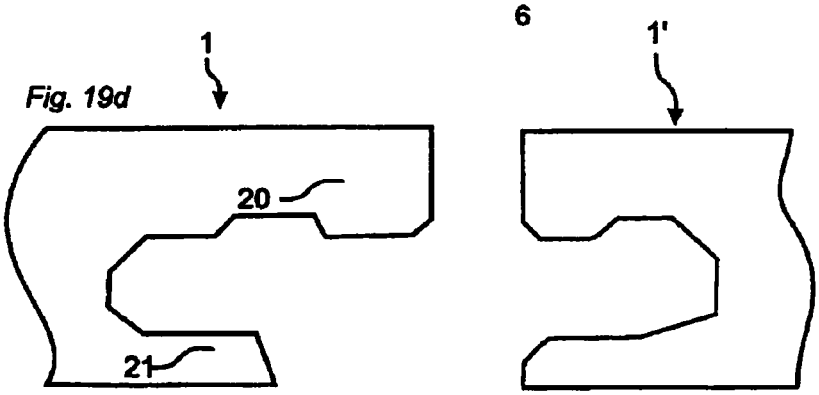
Figure 20A:
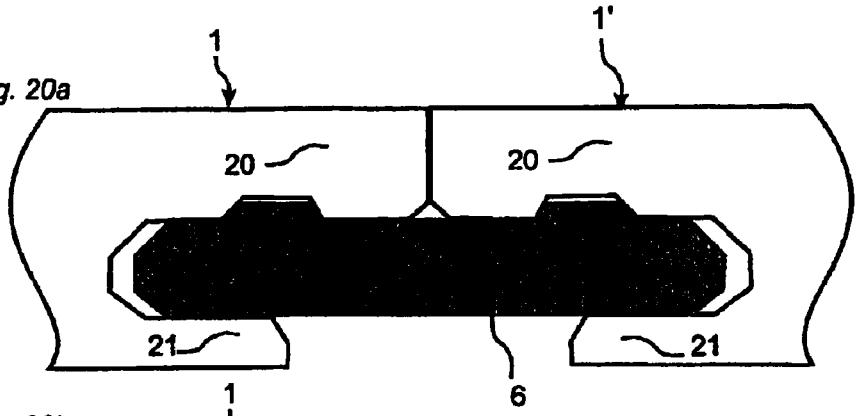
FIGS. 20*a-e* illustrate a preferred embodiment according to the invention with a separate strip having symmetric edge portions.
Figure 20B:
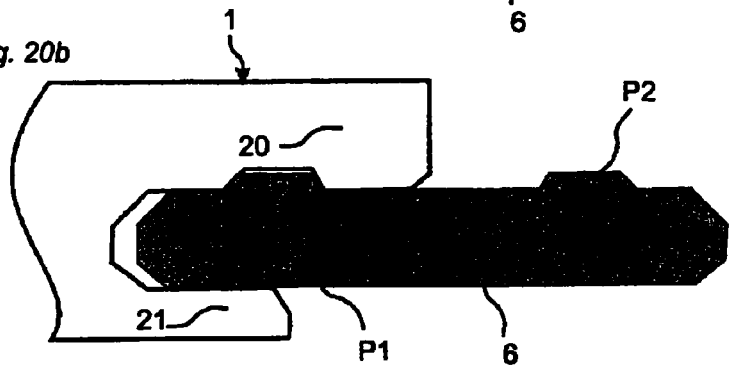
Figure 20C:
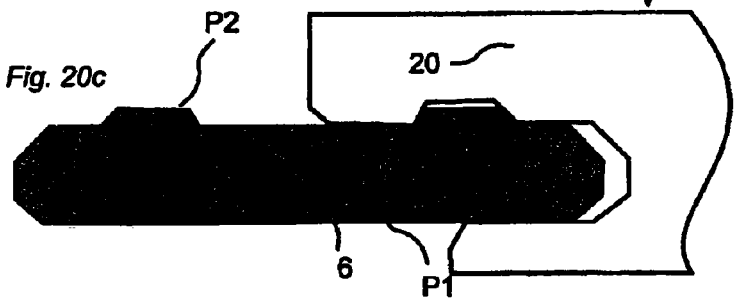
Figure 20D:
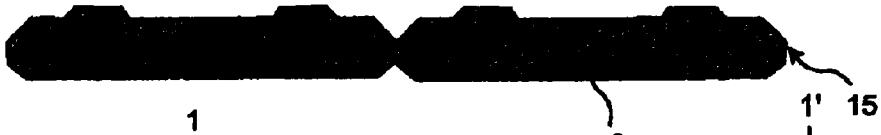
Figure 20E:
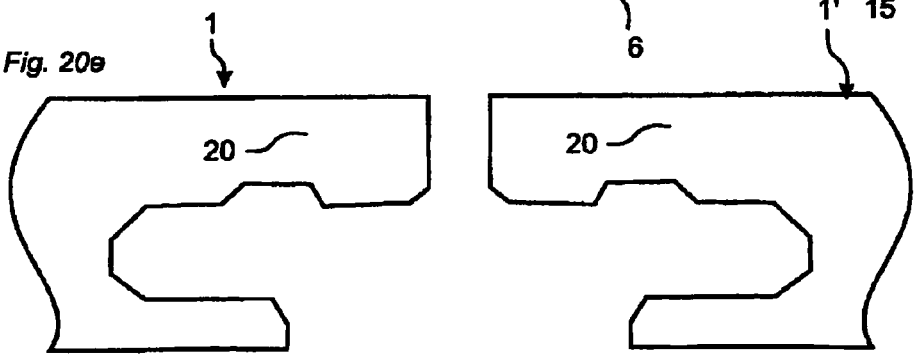

FIG. 17 shows manufacture of a strip blank where all three critical locking and positioning surfaces are made using a divided tool which contains two adjustable tool parts T1A and T1B. These tool parts are fixed in the same tool holder and driven by the same milling motor. This divided tool can be ground and set with great accuracy and allows manufacture of the locking surfaces 10 and 60 as well as the positioning surface 62 with a tolerance of a few hundredths of a millimeter. The movement of the board between different milling motors and between different manufacturing steps thus does not result in extra tolerances.

FIGS. 18*a-d* show an embodiment of the invention where also the tongue 22 is made of a separate material. This embodiment can reduce the waste still more. Since the tongue locks only vertically, no horizontal locking means other than friction are required to fasten the tongue 22 in the floorboard 1'.

FIGS. 19*a-d* show another embodiment of the invention which is characterized in that the projecting portion has a locking element which locks in an undercut groove in the board 1'. Such a locking system can be locked by angling and snapping and it can be unlocked by upward angling about the upper joint edge. Since the floorboard 1' has no tongue, the amount of wasted material can be minimized.

FIGS. 20*a-e* show an embodiment of the invention which is characterized in that the separate strip 6 consists of two symmetric parts, and that the joint portions of the floorboards 1, 1' are identical. This embodiment allows simple manufacture of, for instance, boards which may consist of A and B boards which have mirror-inverted locking systems. The locking system of the preferred geometry is not openable. This can be achieved, for instance, by rounding of the lower and outer parts of the strip 6.

Figures 21, 22, 23, 24, 25, 26:
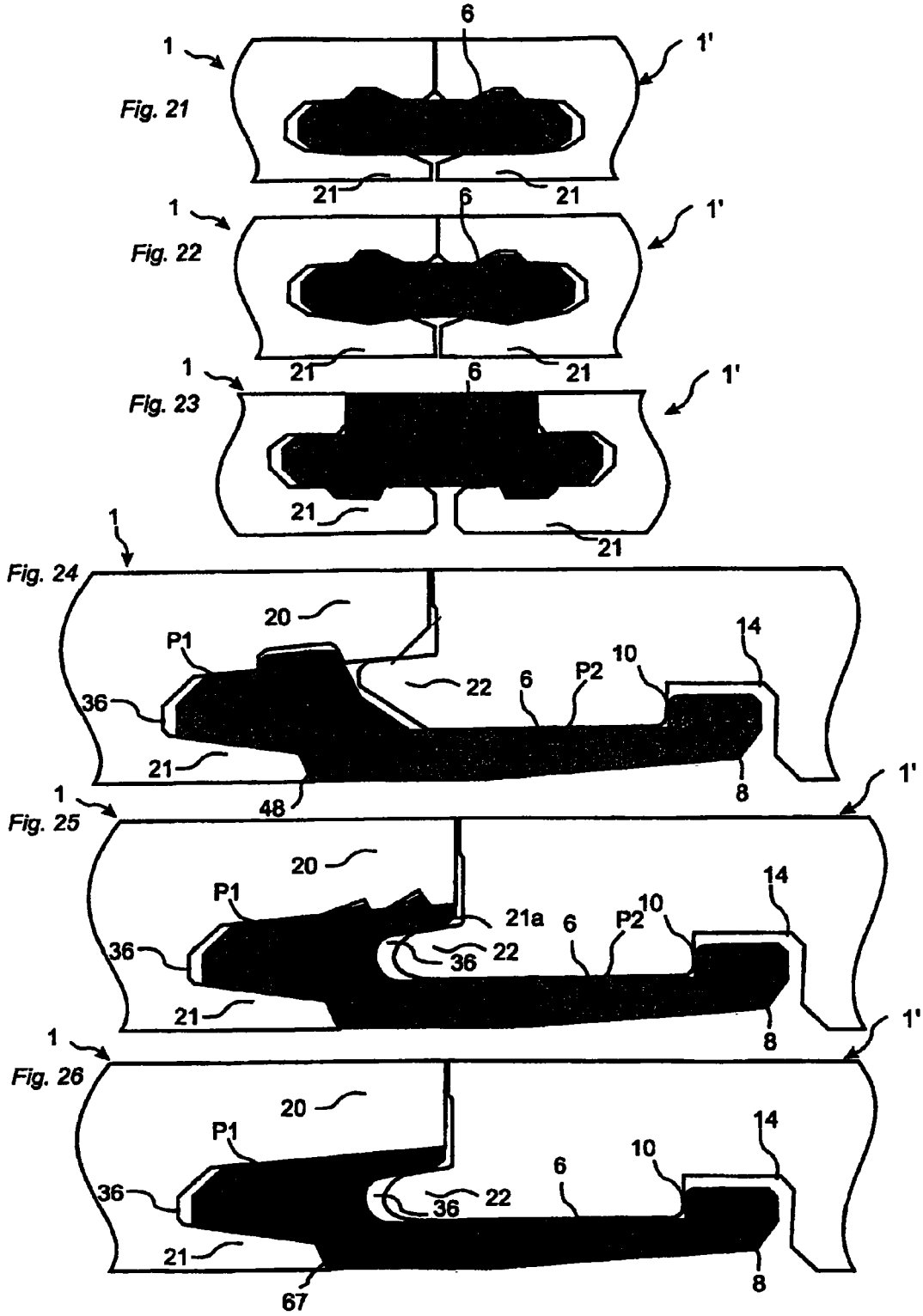
FIGS. 21-26 show examples of different embodiments according to the invention.

FIGS. 21-26 illustrate variants of the invention. FIG. 21 shows an embodiment with lower lips 21 which extend essentially to the vertical plane. FIG. 22 shows an embodiment with locking elements on the upper and lower sides of the strip 6.

FIG. 23 shows a separate strip which is visible from the surface and which may constitute a decorative joint portion. A strip of HDF can be colored and impregnated. A strip of, for example, compact laminate can have a decorative surface part which is moisture-proof and has great wear strength. The strip can be provided with a rubber coating to counteract penetration of moisture. Preferably the strip should only be attached to the long side, and preferably in such a manner that part of the strip projects outside the surface at the short sides of the floorboard. Such attaching should be made after machining of the long side but before machining of the short side. The excess material can then be removed in connection with the machining of the short sides and the strip will have a length corresponding to the length of the surface layer. Decorative strips can be made without visible joints. In this embodiment, the strip locking elements are placed in the lower lip 21.

FIG. 24 shows a separate strip with a tapering projecting portion which improves the flexibility of the strip.

FIG. 25 shows an embodiment where the inner portion P1 of the strip has a strip groove 36. This may facilitate snapping-in of the strip since also the strip groove 36 is resilient by its lip 21 a also being resilient. The strip groove can be made by means of an inclined tool according to prior art. This embodiment is also characterized in that the inner portion P1 has two locking elements.

FIG. 26 shows an embodiment where the inner portion P1 has no locking element. The strip 6 is inserted into the strip groove until it abuts against the lower positioning surface and is retained in this position by frictional forces. Such an embodiment can be combined with gluing which is activated in a suitable prior-art manner by heating, ultrasound etc. The strip 6 can be preglued before being inserted.

Figure 27A:
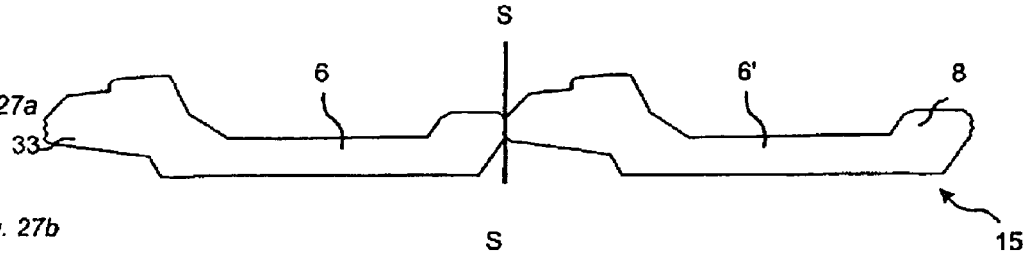
FIGS. 27*a-b* show examples of how the separate strip according to an embodiment of the invention can be separated from the strip blank.
Figure 27B:
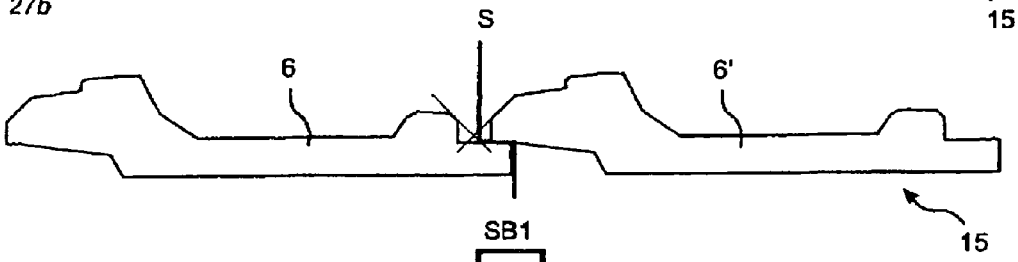

FIGS. 27*a* and *b* show two variants which facilitate separation by the strip 6 being separated from the strip 6' by being broken off. In FIG. 27*a*, the strip 6 is designed so that the outer part of the strip tongue 33 is positioned on the same level as the rear part of the locking element 8. Breaking-off takes place along line S. FIG. 27*b* shows another variant which is convenient especially in HDF material and other similar materials where the fibers are oriented essentially horizontally and where the fracture surface is essentially parallel to the horizontal plane HP. Breaking-off takes place along line S with an essentially horizontal fracture surface.

Figure 28A:
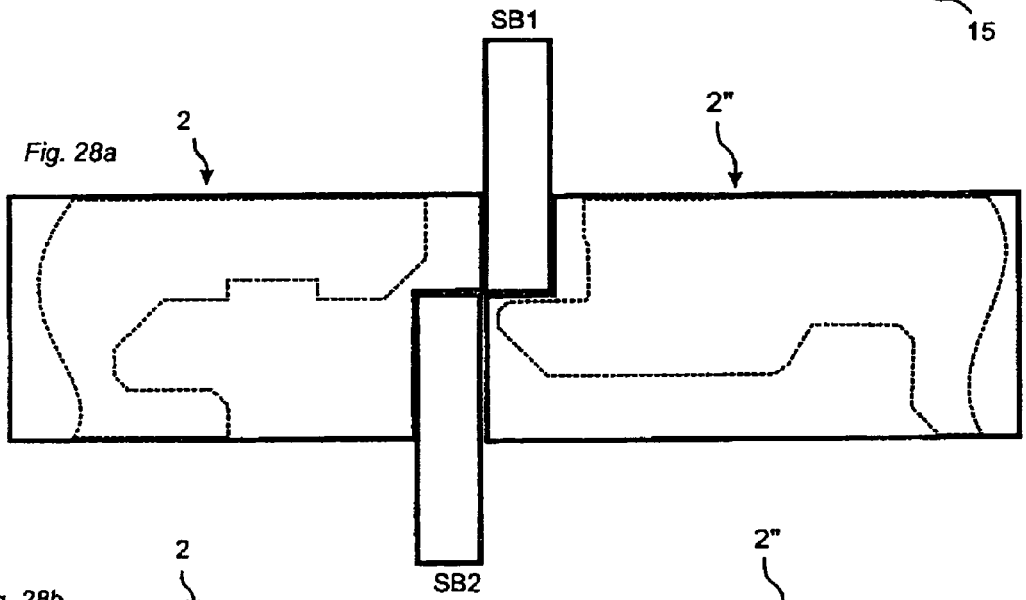
FIGS. 28*a-b* show how sawing of floor elements into floor panels can take place according to an embodiment of the invention so as to minimize the amount of wasted material.
Figure 28B:
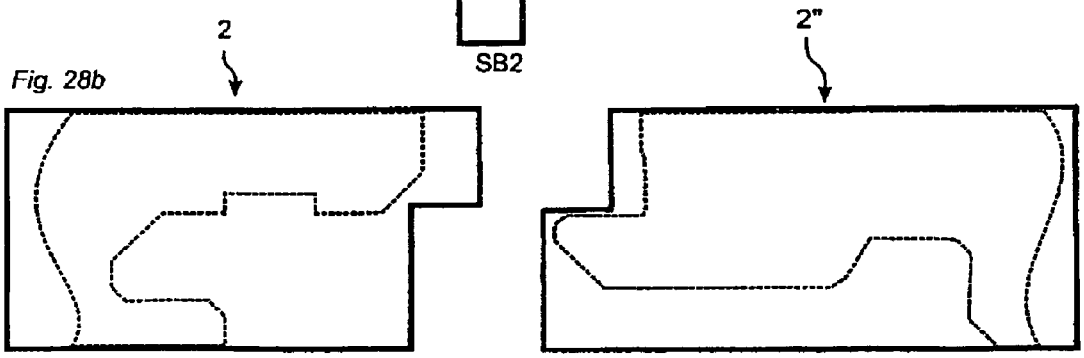

FIGS. 28*a* and *b* show how the amount of wasted material can be minimized in embodiments of the invention where the joint edge is formed with a tongue. Sawing can take place with an upper sawblade SB1 and a lower sawblade SB2 which are laterally offset. The floor elements 2 and 2' will only have an oversize as required for rational machining of the joint edges without taking the shape of the tongue into consideration. By such an embodiment, the amount of wasted material can be reduced to a minimum.

Figure 29A:
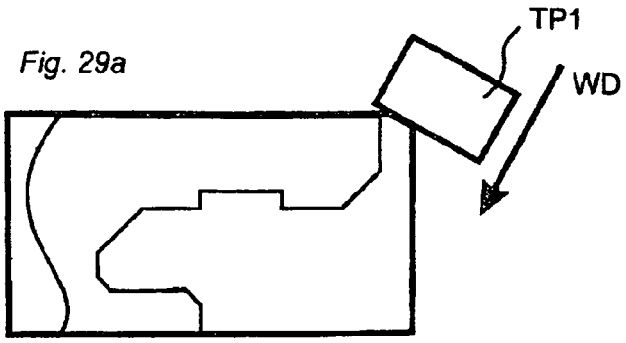
FIGS. 29*a-e* show machining of joint edge portions according to an embodiment of the invention.
Figure 29B:
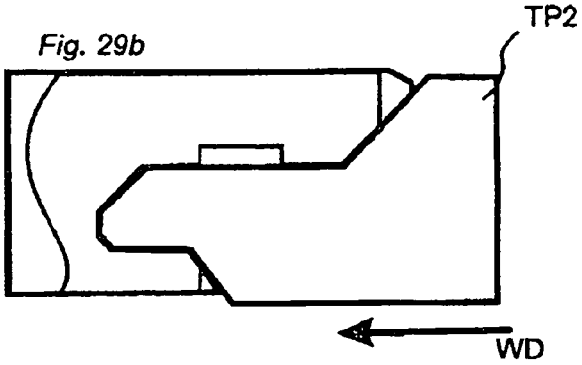
Figure 29C:
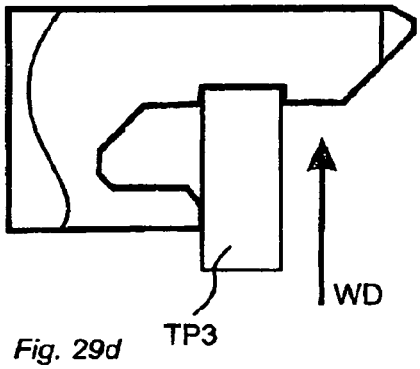
Figure 29D:
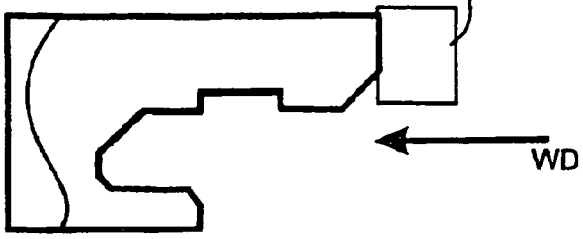
Figure 29E:
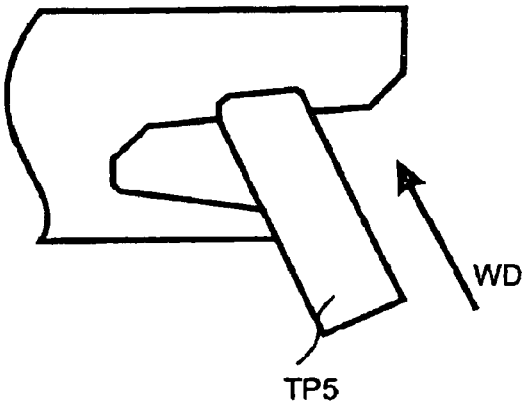

FIGS. 29*a-e* show machining of joint edge portions using diamond cutting tools. A tool TP1 with engaging direction WD machines the laminate surface in prior-art manner and performs premilling. A minimum part of the laminate surface is removed. According to FIG. 29*b*, the strip groove is made and the tool TP2 operates merely in the core material and the rear side. FIG. 29*c* shows how the undercut groove with the locking surface and an upper and a lower positioning surface are formed. All critical surfaces that are essential for the horizontal positioning and locking of the strip can thus be formed with great accuracy using one and the same tool. FIG. 29*e* shows how the corresponding machining can be carried out using an inclined tool TP5. Finally the upper joint edge is machined by means of the tool TP4 in prior-art manner. The joint geometry and the manufacturing methods according to the invention thus make it possible to manufacture floorboards with advanced locking systems. At the same time machining of the joint edges can be carried out using fewer tools than normal, with great accuracy and with a minimum amount of wasted material. Wooden flooring does not require a premilling tool TP1 and machining may therefore take place using three tools only. This method thus makes it possible to provide a locking system with a wood-fiber-based strip extending outside the vertical plane while at the same time the manufacture of the locking system at the groove/strip side can be effected inside the vertical plane. The method thus combines the advantages of a cheap and protruding wood fiber strip and manufacture that does not need to remove large parts of the difficult surface layer.

Figure 30:
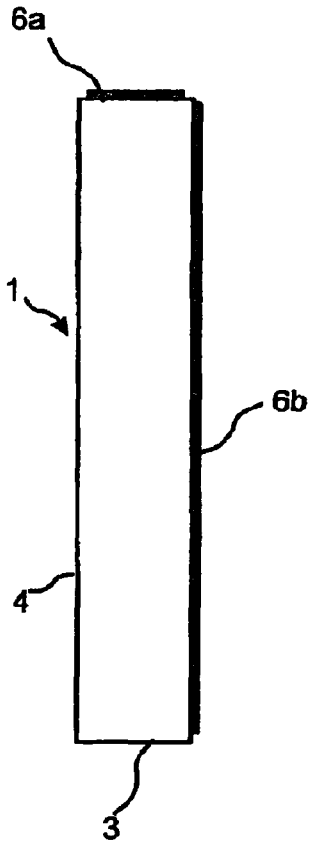
FIG. 30 shows a format corresponding to a normal laminate floorboard with a separate strip on long side and short side according to an embodiment of the invention.
Figure 31:
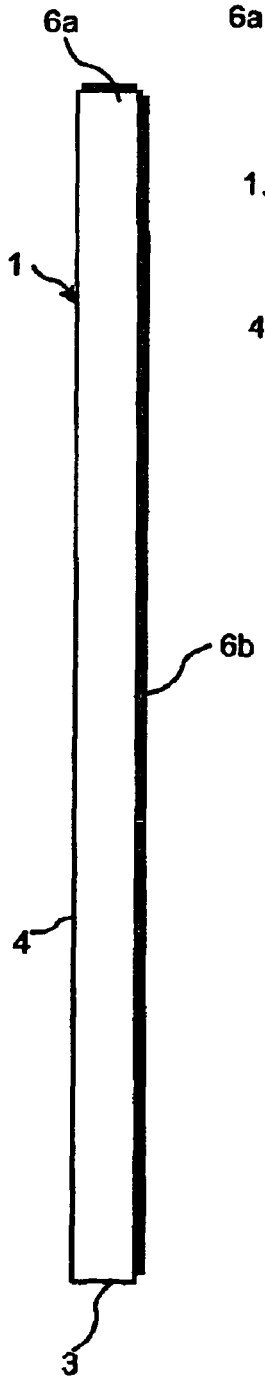
FIG. 31 shows a long and narrow floorboard with a separate strip on long side and short side according to an embodiment of the invention.

FIG. 30 illustrates a normal laminate floorboard with strips 6*b* and 6*a* according to the invention on a long side 4 and a short side 3. The strips can be of the same material and have the same geometry but they may also be different. The invention gives great possibilities of optimizing the locking systems on the long side and short side as regards function, cost and strength. On the short sides where the strength requirements are high and where snapping-in is important, advanced, strong and resilient materials such as compact laminate can be used. In long and narrow formats, the long side contains essentially more joint material, and therefore it has been necessary in traditional locking systems to reduce the extent of the strip outside the joint edge as much as possible. This has made snapping-in difficult or impossible, which is an advantage in certain laying steps where inward angling cannot take place. These limitations are largely eliminated by the present invention. FIG. 31 shows a long and narrow floorboard which necessitates a strong locking system on the short side. The saving in material that can be made using the present invention in such a floorboard is considerable.

Figure 32A:
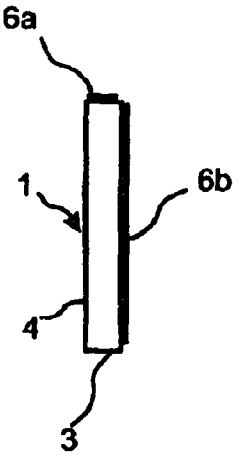
FIGS. 32*a-b* show formats corresponding to a parquet block in two mirror-inverted embodiments with a separate strip on long side and short side according to an embodiment of the invention.
Figure 32B:
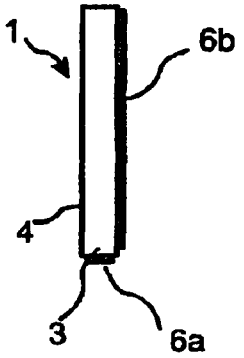

FIGS. 32*a-b* show formats resembling parquet blocks. A mechanical locking system of a traditional type can in such a format, for instance 70*400 mm, cause an amount of wasted material of more than 15%. Such formats are not available on the market as laminates. According to the present invention, these formats can be manufactured rationally with a mechanical locking system which is less expensive than also traditional systems using tongue, groove and glue. They can also, as shown in these two Figures, be manufactured with a mirror-inverted system where the strip on the short side is alternately snapped into the upper and lower short sides.

Figure 33:
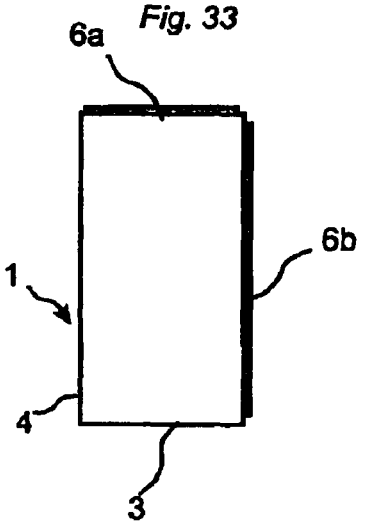
FIG. 33 shows a format which is suitable for imitating stones and tiles with a separate strip on long side and short side according to an embodiment of the invention.

FIG. 33 shows a format with a wide short side. Such a format is difficult to snap in since downward bending of the long strip 6*a* on the short side means that a great bending resistance must be overcome. According to the present invention, this problem is solved by the possibility of using flexible materials in the separate strip which also according to the description above can be made partially turnable in the inner portion.

Figure 33A:
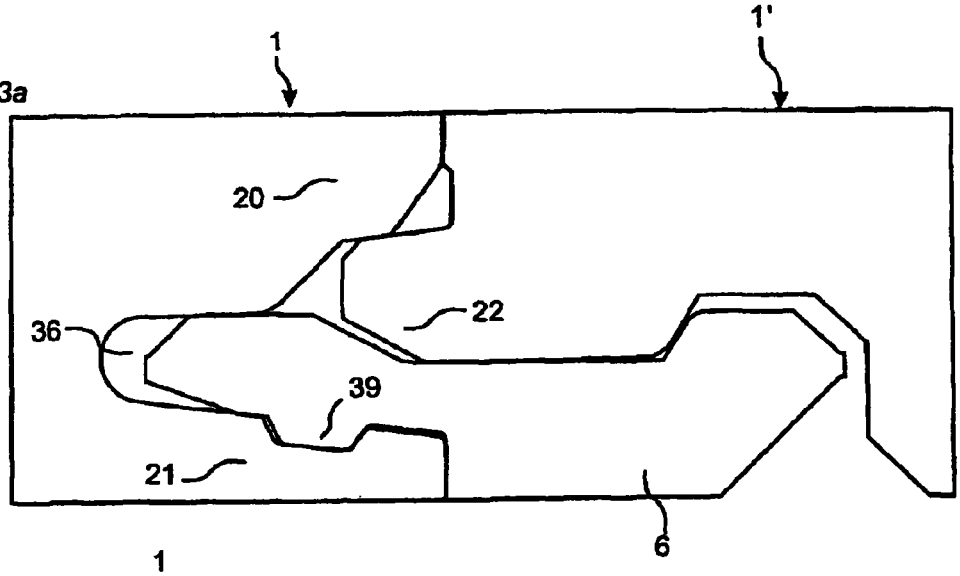
FIGS. 33*a-c* illustrate an embodiment with a separate strip which is locked mechanically in the lower lip and which is joined by a combination of snapping-in and inward angling towards the joint edge.
Figure 33B:
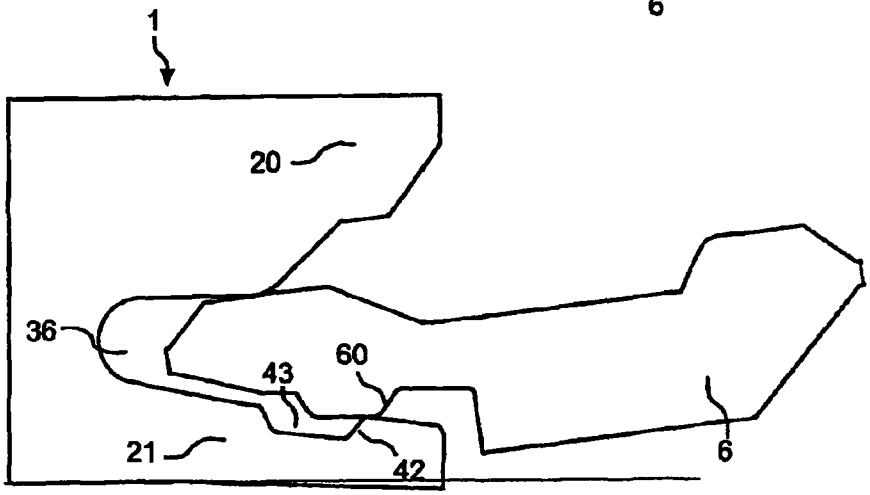
Figure 33C:
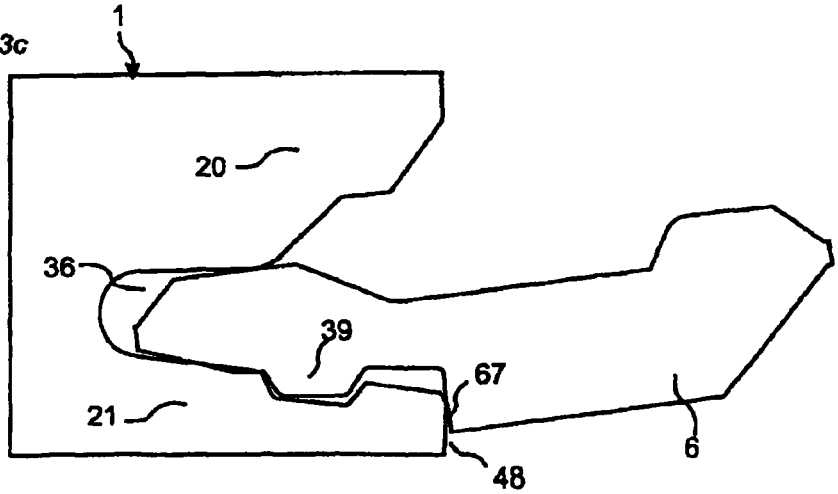

FIGS. 33*a-c* show a production-adjusted embodiment with a separate strip 6 which has coacting horizontal locking surfaces 60, 42 in the lower lip 21. FIGS. 33*b* and *c* show how the strip is snapped in a slightly angled position. Snapping-in can take place by a downward bending of the lower lip 21 which can be limited to, for instance, half the height of the strip locking element 39. Thus the lower lip can be relatively rigid and this prevents snapping-out in case of tension load. An advantage of this embodiment is also that when the floorboards 1,1' are joined and subjected to tension load, the tongue 22 will prevent the strip 6 from sliding upwards. In this embodiment, the strip will have a stronger attachment when the floorboards are joined than in the case when the floorboards are not mounted. The strip 6 can also easily be taken off by upward angling and this is advantageous when floorboards are laid against a wall in the first or last row.

Figure 34A:
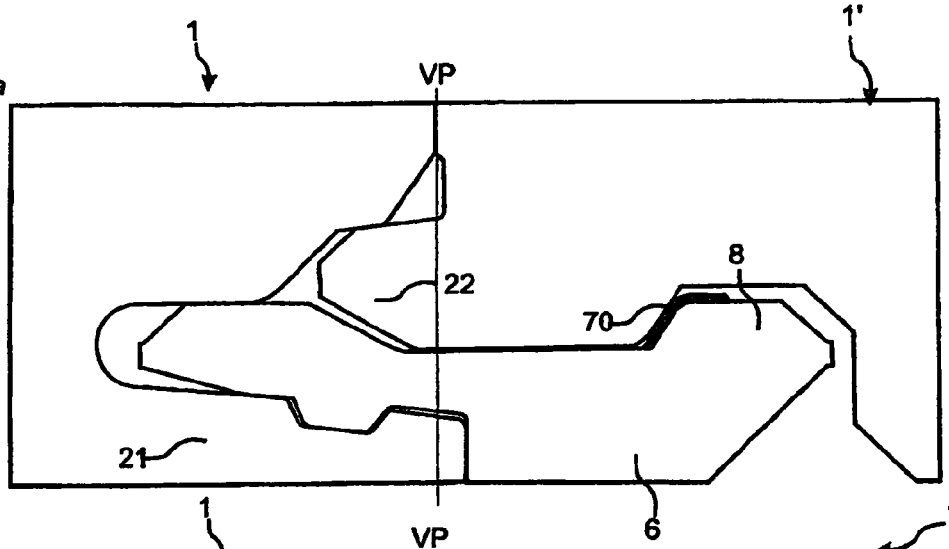
FIGS. 34*a-c* show different variants with the strip locked in the lower lip.
Figure 34B:
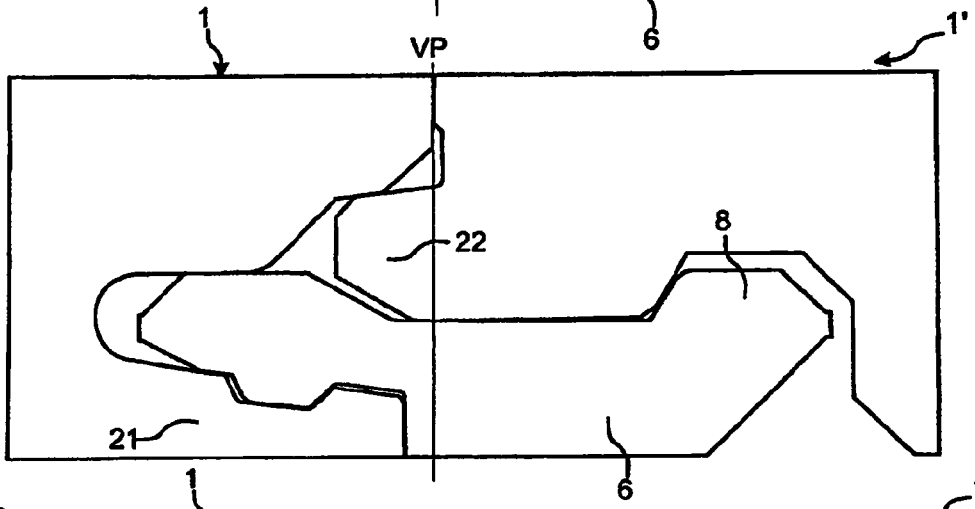
Figure 34C:
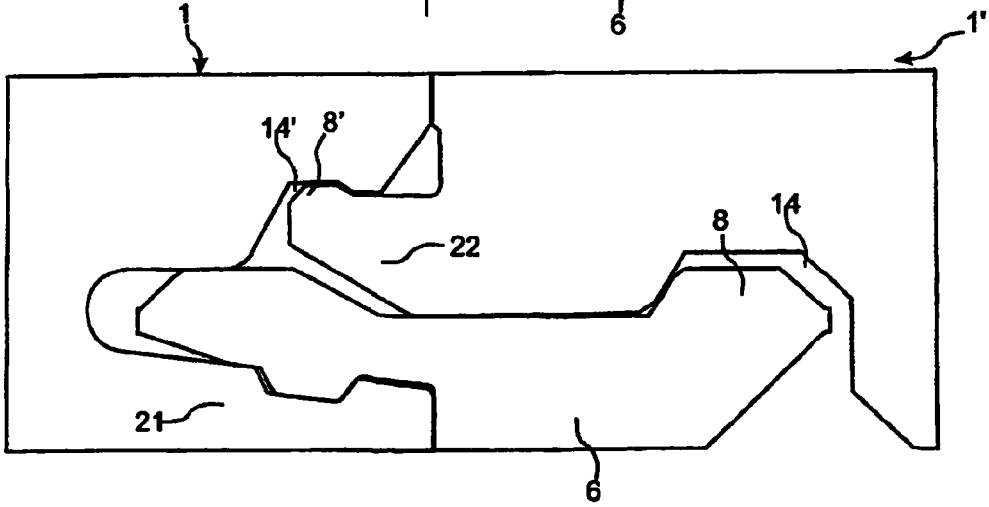

FIGS. 34*a*-34*c* show different embodiments with a lower lip outside and inside the vertical plane VP. FIG. 34*c* shows a strong locking system with double horizontal locking means 14, 8 and 14', 8'. The separate strip 6 makes it possible to easily manufacture the undercut locking groove 14' using large rotating tools since in connection with this manufacture there is no strip 6 at the joint edge portion.

Figure 35A:
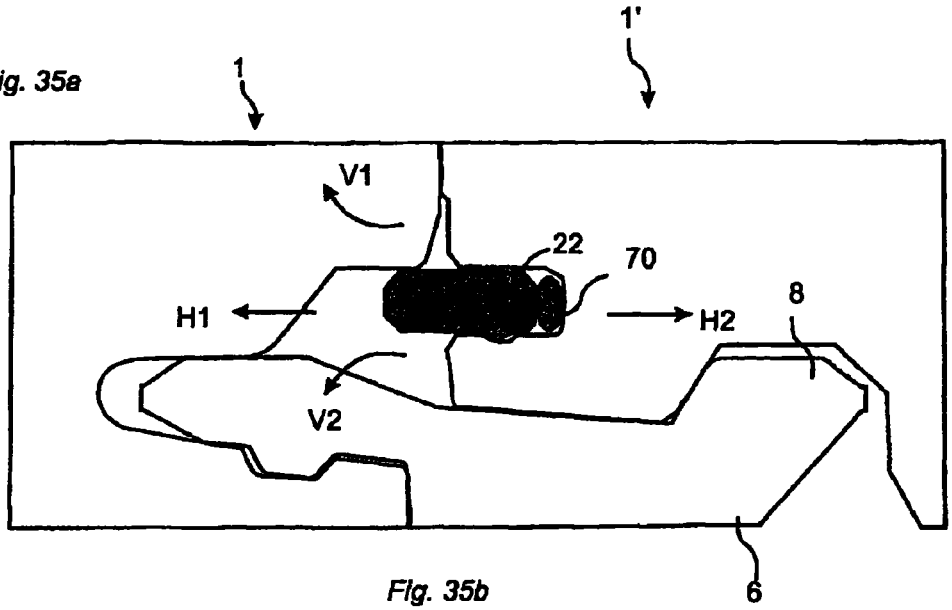
FIGS. 35*a-e* show an embodiment with a separate flexible tongue and taking-up of a floorboard.
Figure 35B:
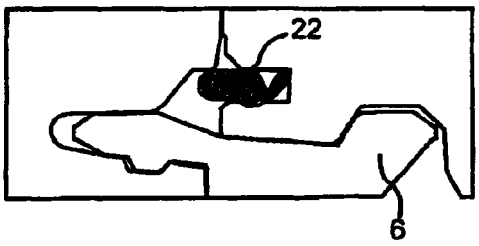
Figure 35C:
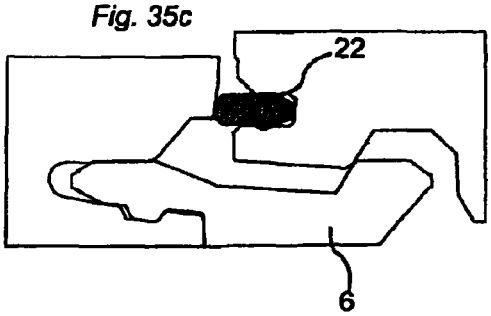
Figure 35D:
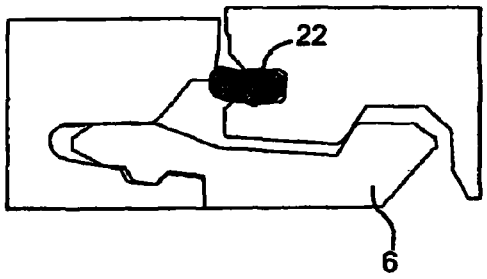
Figure 35E:
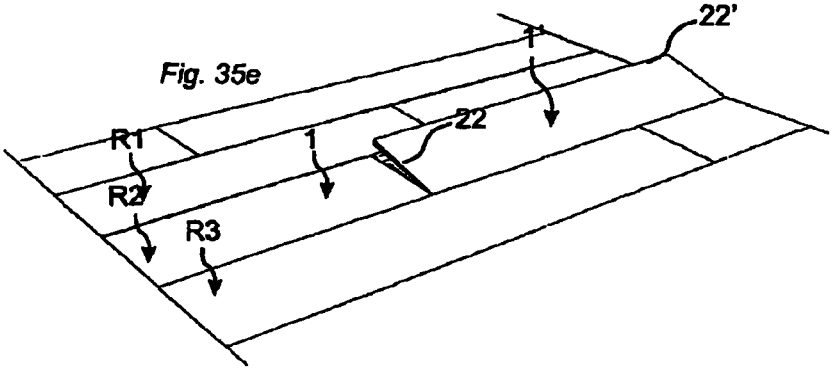

FIGS. 35*a-e* show how a joint system can be manufactured with a flexible tongue 22 which can be displaced and/or compressed horizontally H1, H2 or alternatively be bent vertically upwards V1 or downwards V2. FIG. 35*a* shows a separate tongue 22 of, for instance, wood fiber material which can be displaced horizontally in the H1, H2 direction by means of a flexible material 70, such as a rubber material. FIG. 35*b* shows an embodiment with a tongue 22 having an inner part which is resilient. FIGS. 35*c-d* show how a flexible tongue can be changed in shape so that locking and unlocking can take place by a vertical motion. FIG. 35*e* shows how a first floorboard 1' can be released by upward angling using, for example, suction cups or suitable tools which are applied to the floorboard edge closest to the wall. The floorboard has on a long side and a short side flexible tongues 22' and 22. After upward angling, a neighboring floorboard in the same row R2 can be released and optionally be laid once more in the same manner. Once the entire row is released, the rows R1 and R3 can be taken up in prior-art manner. Floorboards with such a preferred system have great advantages mainly in large floors. Floorboards can be exchanged in an optional row. A damaged floorboard in the center of a floor can, when using most of the currently existing locking systems, only be replaced if half the floor is taken up. The floor may consist of, for instance, one or more rows of the above-mentioned floorboards in the portions where the possibility of taking-up is especially important. The tongue 22 should preferably be made of a flexible material, such as plastic. Wood-fiber-based materials can also be used, for instance HDF. Vertical taking-up is facilitated if the flexible tongue is combined with a strong and flexible loose strip which has a preferably strong and flexible locking element having smooth locking surfaces with low friction.

Figure 36A:
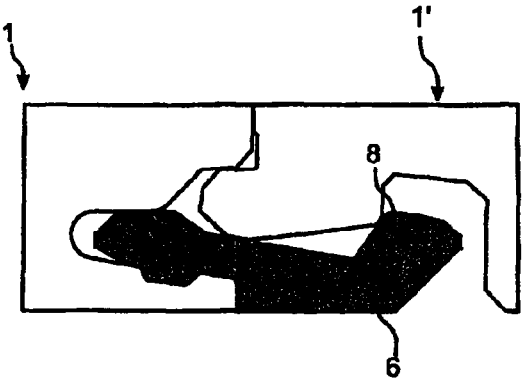
FIGS. 36*a-f* show a method of releasing floorboards which have a separate strip.
Figure 36B:
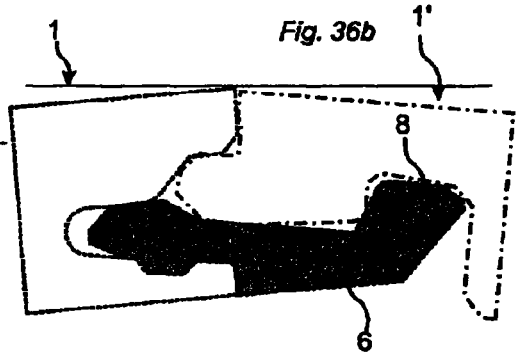
Figure 36C:
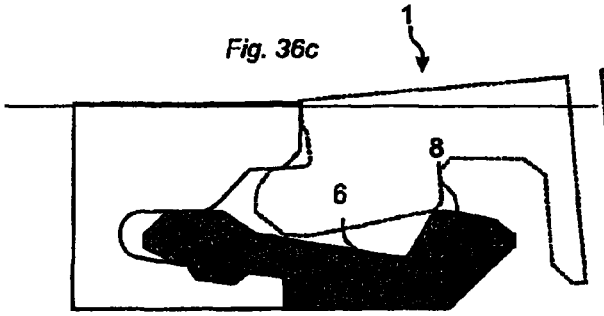
Figure 36D:
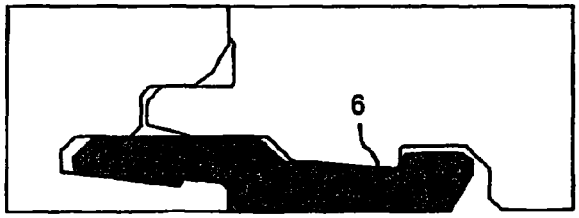
Figure 36E:
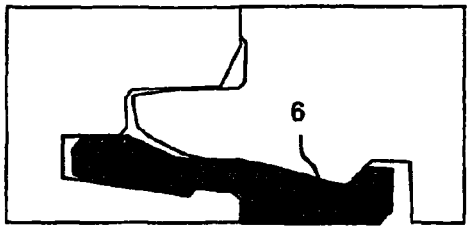
Figure 36F:
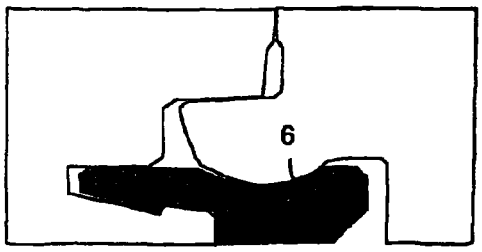

FIGS. 36*a*-36*b* show how a joint system with a separate strip can be designed to allow an angular motion in prior-art manner with the rear sides of the floorboards against each other. Such systems exist only with the strip made in one piece with the core of the floorboard and are difficult to use. FIG. 36*b* shows how the floorboards 1, 1', in a relative rearward bending through about 10 degrees, release the tongue side of the floorboard 1 which can be released at half the angle, in this case about 5 degrees. With this method, individual boards cannot be released. As a rule, at least two rows must be angled upwards at the same time. Rearward angling is facilitated significantly if the strip is wide, has low friction and is flexible. A rotary motion in the groove where the strip 6 is attached is also advantageous. All this can be achieved with a separate strip adapted to this function. FIGS. 36*d-f* show examples of existing locking systems on the market, for instance manufactured under the trademarks Berry, Unilin and Classen, which have been adapted so that the existing machined strip which is made in one piece with the core is replaced by a separate strip according to the invention. It is thus possible to provide locking systems according to the invention which are perfectly compatible with existing products on the market.

It is obvious that a large number of variants of preferred embodiments are conceivable. First, the different embodiments and descriptions can be combined wholly or partly. The inventor has also tested a number of alternatives where geometries and surfaces with different angles, radii, vertical and horizontal extents and the like have been manufactured. Beveling and rounding-off can result in a relatively similar function. A plurality of other joint surfaces can be used as positioning surfaces. The thickness of the strip may be varied and it is possible to machine materials and make strips of board materials that are thinner than 2 mm. A large number of known board materials, which can be machined and are normally used in the floor, building and furniture industries, have been tested and found usable in various applications of the invention. Since the strip is integrated mechanically, there are no limitations in connection with the attachment to the joint edge as may be the case when materials must be joined with each other by means of gluing.

Although only preferred embodiments are specifically illustrated and described herein, it will be appreciated that many modifications and variations of the present invention are possible in light of the above teachings and within the purview of the appended claims without departing from the spirit and intended scope of the invention.

The invention claimed is:

1. A method for manufacturing floorboards, said floorboards comprising wood fibers oriented essentially in a plane, the method comprising:

cutting a first portion of a single solid unitary piece of floorboard material that is continuous without division to form a first cut in at one portion of the floorboard material, the first cut cutting only part way through the floorboard material;

cutting a second portion of the single solid unitary piece of floorboard material to form a second cut at a second portion of the floorboard material, the second cut cutting only part way through the floorboard material; and fracturing the single solid unitary piece of floorboard material along a region connecting the first and second cuts into at least two pieces by providing a force on one of the at least two pieces and an opposing force on the other of the at least two pieces such that the fracture occurs by breaking off a piece in the plane of the wood fibers.

2. The method of claim 1, wherein the floorboard material is a blank for floorboards with a mechanical locking system, said blank comprising the at least two pieces of floorboard material as a single solid unitary piece that is continuous without division before fracture, and wherein the fracturing step fractures a piece of floorboard material from the blank.

3. The method of claim 2, the method further comprising forming a fracture line between said first and second cuts, said fracture line being formed to facilitate fracture of one of said pieces of floorboard material in the plane of the wood fibers.

4. The method of claim 3, wherein the blank has a side edge that comprises edges of the at least two pieces of floorboard material, and a top surface, the top surface defining a horizontal plane, wherein the wood fibers are oriented essentially parallel to the horizontal plane.

5. The method of claim 4, the method further comprising:

fracturing a piece of floorboard material from the blank along the fracture line to form a fracture surface on the piece of floorboard material at the fracture line, the fracture surface being essentially parallel to the horizontal plane.

6. The method of claim 3, wherein the blank comprises HDF material.

7. The method of claim 1, wherein the region connecting the first and second cuts forms part of a mechanical locking system of at least one of the floorboards.

8. The method of claim 1, wherein the cutting steps are performed with a saw.

9. A method for manufacturing floorboards, the method comprising:

orienting wood fibers essentially in a plane of a single solid unitary piece of floorboard material that is continuous without division;

cutting a first portion the single solid unitary piece of floorboard material to form a first cut in at one portion of the floorboard material, the first cut cutting only part way through the floorboard material;

cutting a second portion of the single solid unitary piece of floorboard material to form a second cut at a second portion of the floorboard material, the second cut cutting only part way through the floorboard material; and fracturing the single solid unitary piece of floorboard material along a region connecting the first and second cuts into at least two pieces such that the fracture occurs in the plane of the wood fibers.

10. The method of claim 9, the fracturing step comprising:

providing a force on one of the at least two pieces and an opposing force on the other of the at least two pieces such that the fracture occurs by breaking off a piece in the plane of the wood fibers.

11. The method of claim 9, wherein the floorboard material is a blank for floorboards with a mechanical locking system, said blank comprising the at least two pieces of floorboard material as a single solid unitary piece that is continuous without division before fracture, and wherein the fracturing step fractures a piece of floorboard material from the blank.

12. The method of claim 11, the method further comprising forming a fracture line between said first and second cuts, said fracture line being formed to facilitate fracture of one of said pieces of floorboard material in the plane of the wood fibers.

13. The method of claim 12, wherein the blank has a side edge that comprises edges of the at least two pieces of floorboard material, and a top surface, the top surface defining a horizontal plane, wherein the wood fibers are oriented essentially parallel to the horizontal plane.

14. The method of claim 13, the method further comprising:

fracturing a piece of floorboard material from the blank along the fracture line to form a fracture surface on the piece of floorboard material at the fracture line, the fracture surface being essentially parallel to the horizontal plane.

15. The method of claim 12, wherein the blank comprises HDF material.

16. The method of claim 9, wherein the region connecting the first and second cuts forms part of a mechanical locking system of at least one of the floorboards.

17. The method of claim 9, wherein the cutting steps are performed with a saw.

* * * * *